US009687716B2

(12) United States Patent
George

(10) Patent No.: US 9,687,716 B2
(45) Date of Patent: Jun. 27, 2017

(54) TRAINING DEVICE FOR PERFORMANCE ENHANCEMENT WITHIN SPORTS

(76) Inventor: Nathaniel L. George, San Jose, CA (US)

( * ) Notice: Subject to any disclaimer, the term of this patent is extended or adjusted under 35 U.S.C. 154(b) by 691 days.

(21) Appl. No.: 12/229,382

(22) Filed: Aug. 22, 2008

(65) Prior Publication Data

US 2009/0098945 A1 Apr. 16, 2009

Related U.S. Application Data

(60) Provisional application No. 60/965,949, filed on Aug. 22, 2007.

(51) Int. Cl.

| | |
|---|---|
| ***A63B 69/36*** | (2006.01) |
| ***A63B 21/055*** | (2006.01) |
| ***A63B 69/00*** | (2006.01) |
| ***A63B 69/38*** | (2006.01) |
| ***A63B 21/00*** | (2006.01) |
| *A63B 21/04* | (2006.01) |
| *A63B 23/14* | (2006.01) |

(52) U.S. Cl.

CPC ..... *A63B 69/3608* (2013.01); *A63B 21/0552* (2013.01); *A63B 21/4001* (2015.10); *A63B 21/4009* (2015.10); *A63B 21/4015* (2015.10); *A63B 21/4019* (2015.10); *A63B 69/0002* (2013.01); *A63B 69/0059* (2013.01); *A63B 69/3632* (2013.01); *A63B 69/38* (2013.01); *A63B 21/0442* (2013.01); *A63B 23/14* (2013.01); *A63B 2209/10* (2013.01)

(58) Field of Classification Search

CPC ..... A63B 21/0552; A63B 2/4025; A63B 2208/0204; A63B 21/0442; A63B 21/0557; A63B 21/4009; A63B 69/0059; A63B 21/4013; A63B 21/4019; A63B 21/00185

USPC ..... 473/458, 464, 274–278, 207–217; 482/124

See application file for complete search history.

(56) References Cited

U.S. PATENT DOCUMENTS

| | | | | |
|---|---|---|---|---|
| 475,432 | A | 5/1892 | Blades | |
| 650,656 | A * | 5/1900 | Raabe | 482/124 |
| 802,623 | A | 10/1905 | Camp | |
| 3,937,465 | A | 2/1976 | Roland | |
| 4,377,284 | A | 3/1983 | Okerlin | |
| 4,383,685 | A | 5/1983 | Bishop | |
| 4,445,686 | A | 5/1984 | Daugherty | |
| 4,519,608 | A | 5/1985 | Gilly | |
| 4,805,905 | A | 2/1989 | Haub | |
| 4,919,425 | A | 4/1990 | Wolf | |
| 5,005,833 | A | 4/1991 | Groveman | |
| 5,114,142 | A | 5/1992 | Gillespie | |
| 5,135,217 | A | 8/1992 | Swain | |

(Continued)

*Primary Examiner* — Mark Graham
(74) *Attorney, Agent, or Firm* — Owen J. Bates

(57) ABSTRACT

The present invention relates to devices more specifically for use in sports training in the fields of baseball, softball, golf, tennis, and other sports requiring control of, and the accuracy of a swing of the wrists, the positioning and follow through of the foots, and the positioning of the body when developing its precision and its reactions to moving objects. Important to the concept is the location of the pivot point or "center of action" associated with the muscular control developed when using this device. By attaching the resistance bands at the waist, proper control and muscle development relating to improved performance is accomplished.

18 Claims, 34 Drawing Sheets

(56) References Cited

U.S. PATENT DOCUMENTS

| | | | | | |
|---|---|---|---|---|---|
| 5,165,696 | A | | 11/1992 | Saha | |
| 5,174,564 | A | | 12/1992 | Young, III | |
| 5,188,356 | A | | 2/1993 | Furr | |
| 5,228,682 | A | | 7/1993 | Wolf | |
| 5,236,190 | A | | 8/1993 | Moss | |
| 5,320,342 | A | | 6/1994 | Houck | |
| 5,362,295 | A | * | 11/1994 | Nurge | 482/124 |
| 5,372,565 | A | * | 12/1994 | Burdenko | 482/124 |
| 5,460,385 | A | | 10/1995 | Lazzeroni | |
| 5,465,428 | A | * | 11/1995 | Earl | 2/238 |
| 5,476,257 | A | | 12/1995 | Bobby | |
| 5,544,877 | A | | 8/1996 | Brownell | |
| 5,551,085 | A | * | 9/1996 | Leighton | 2/44 |
| 5,591,089 | A | | 1/1997 | Huffines | |
| 5,618,040 | A | | 4/1997 | Parten | |
| 5,688,137 | A | | 11/1997 | Bustance | |
| 5,704,856 | A | * | 1/1998 | Morse | 473/422 |
| 5,746,663 | A | | 5/1998 | Calace | |
| 5,803,881 | A | | 9/1998 | Miller | |
| 5,813,955 | A | * | 9/1998 | Gutkowski et al. | 482/124 |
| 5,816,952 | A | | 10/1998 | Blevins | |
| 5,833,233 | A | | 11/1998 | Strug | |
| 5,938,547 | A | | 8/1999 | Gilford | |
| 5,938,548 | A | | 8/1999 | Upshaw | |
| 5,954,598 | A | | 9/1999 | Carlson | |
| 5,976,026 | A | | 11/1999 | Erb | |
| 5,993,362 | A | * | 11/1999 | Ghobadi | 482/124 |
| 6,013,044 | A | | 1/2000 | Estwanik | |
| 6,095,936 | A | | 8/2000 | Kirkpatrick | |
| 6,203,453 | B1 | | 3/2001 | Coddens | |
| 6,231,464 | B1 | | 5/2001 | Curtis | |
| 6,283,877 | B1 | | 9/2001 | Cook | |
| 6,322,462 | B1 | | 11/2001 | Kafer | |
| 6,375,581 | B1 | | 4/2002 | Urban | |
| 6,514,163 | B2 | | 2/2003 | Burns | |
| 6,645,093 | B2 | | 11/2003 | Sheppard | |
| 6,773,366 | B2 | | 8/2004 | Gray | |
| 6,793,585 | B1 | | 9/2004 | Miyamoto | |
| 6,827,654 | B2 | | 12/2004 | Meyer | |
| 6,918,844 | B2 | | 7/2005 | Socci | |
| 6,932,724 | B2 | | 8/2005 | Socci | |
| 6,984,184 | B2 | | 1/2006 | Gray | |
| 7,004,892 | B2 | * | 2/2006 | Marco | 482/124 |
| D518,535 | S | * | 4/2006 | Haskell | D21/662 |
| 7,128,658 | B2 | | 10/2006 | DuFour | |
| 7,131,916 | B2 | | 11/2006 | Griffin | |
| 7,172,522 | B1 | | 2/2007 | Harvey | |
| 2002/0068667 | A1 | * | 6/2002 | Strachan | 482/124 |
| 2006/0122547 | A1 | * | 6/2006 | Stewart et al. | 602/19 |
| 2007/0287616 | A1 | * | 12/2007 | Weaver | 482/124 |
| 2008/0194390 | A1 | * | 8/2008 | Todd | 482/124 |

* cited by examiner

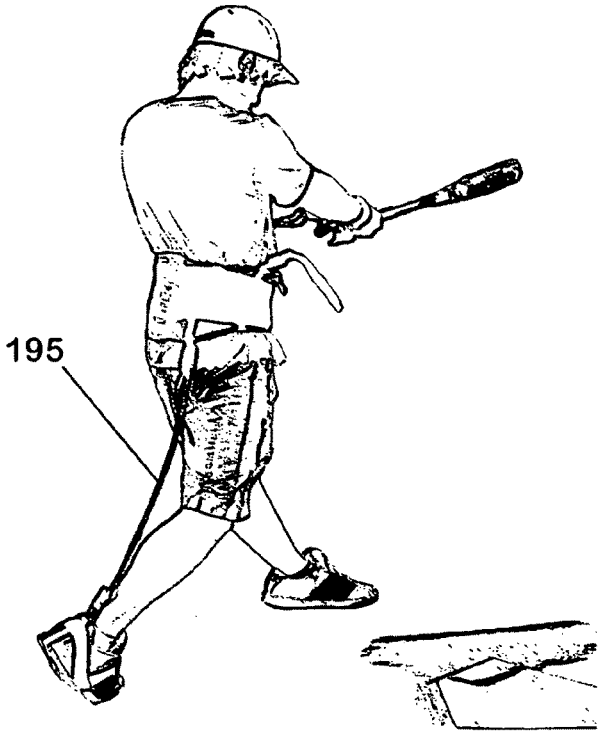
Fig. 44
Fig. 45
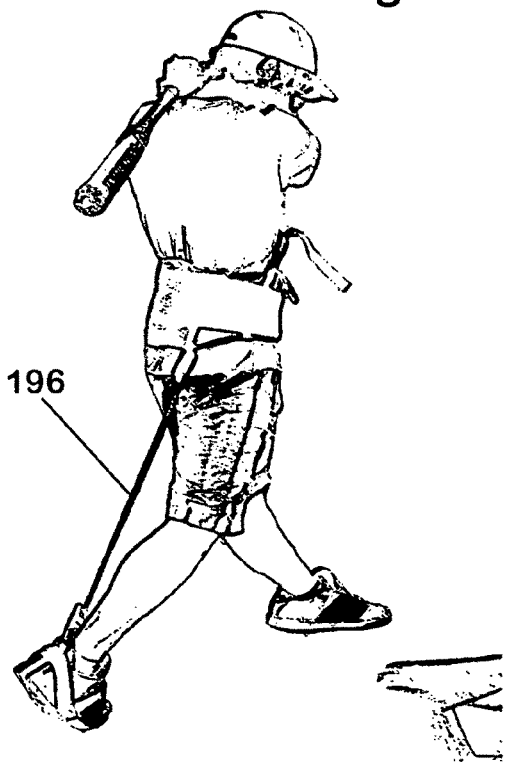

Fig. 46
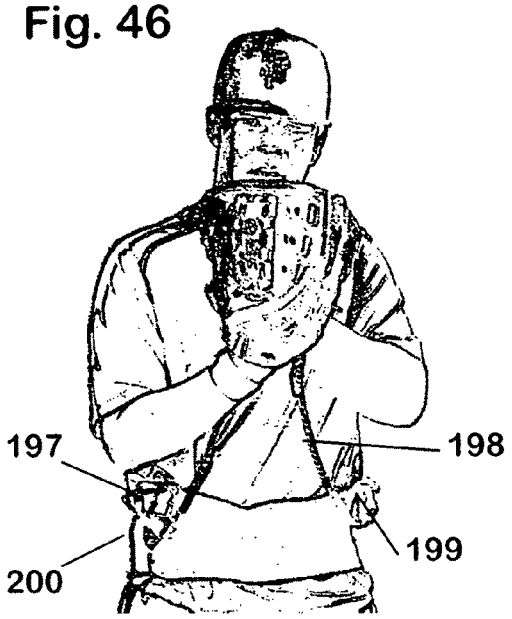
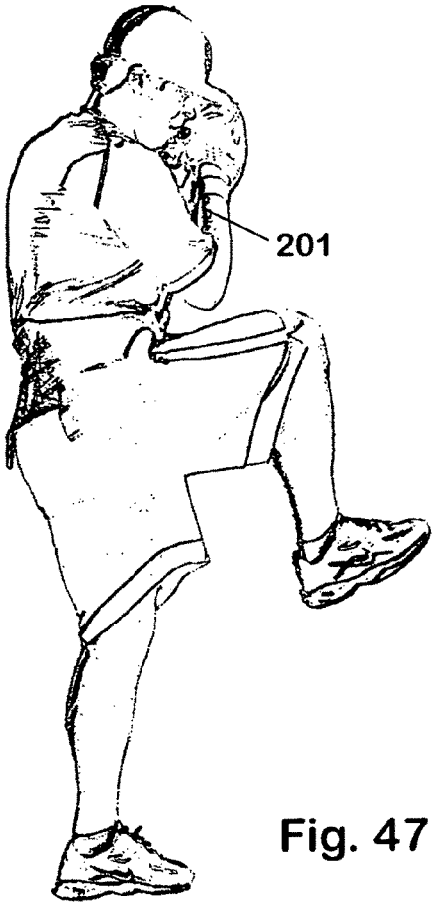
Fig. 47
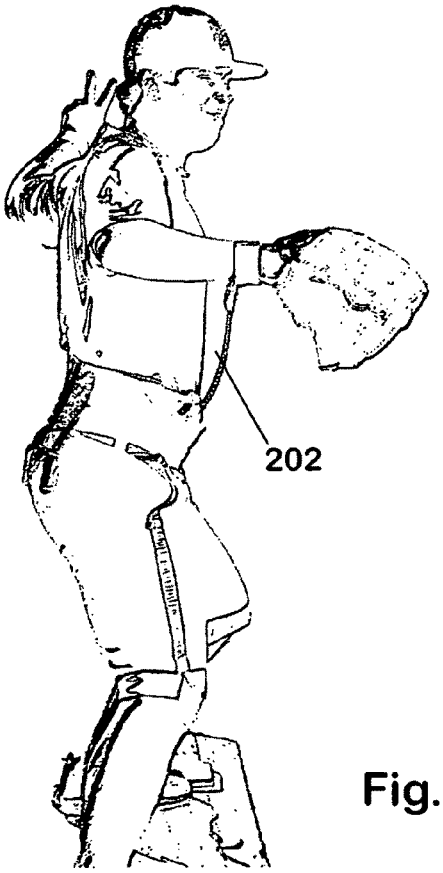
Fig. 48

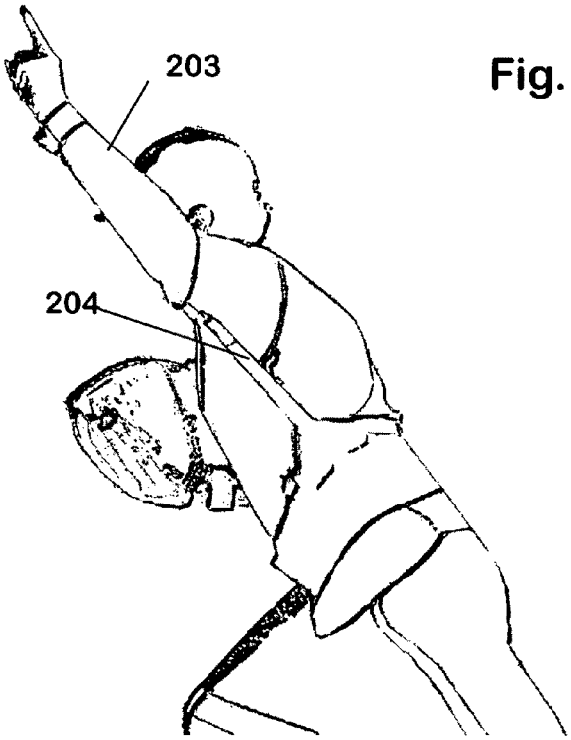
Fig. 49
Fig. 50
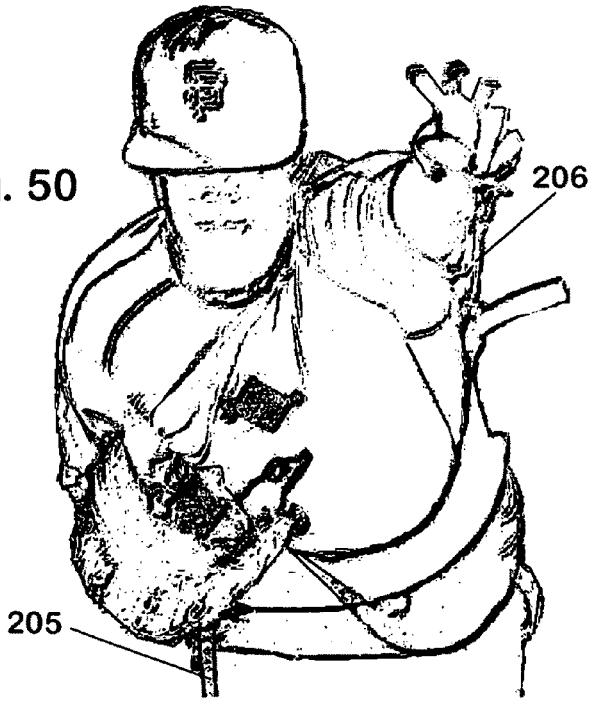

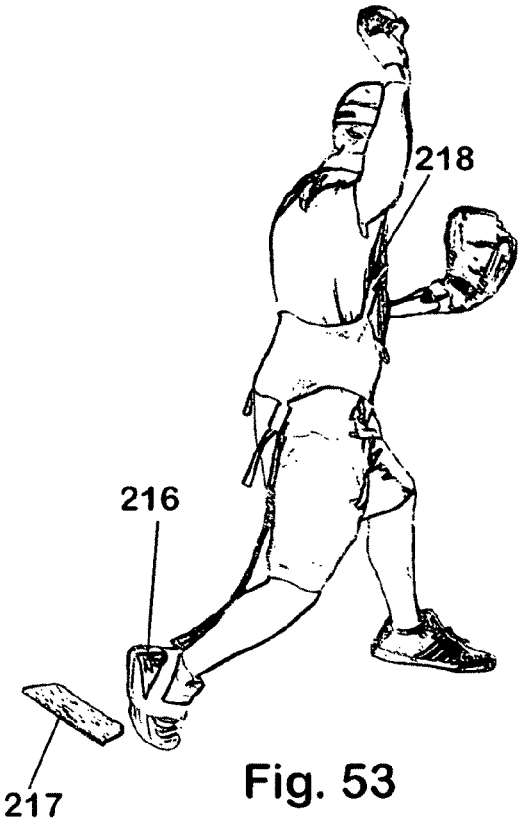
Fig. 53
Fig. 54
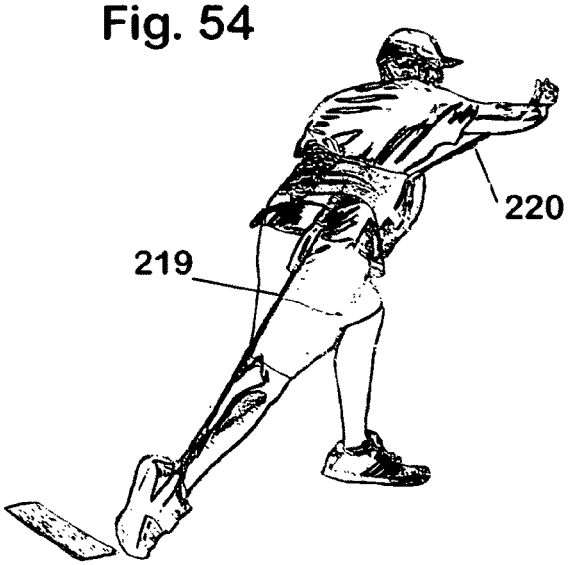
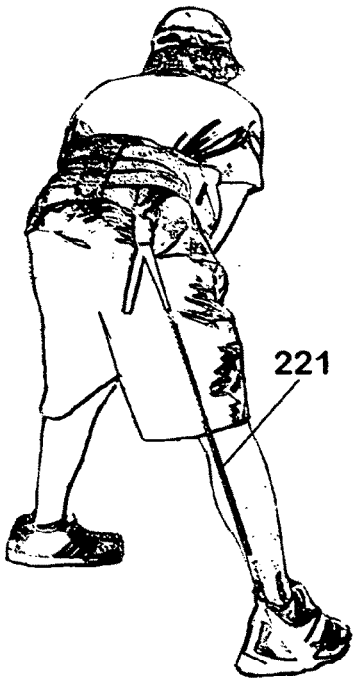
Fig. 55

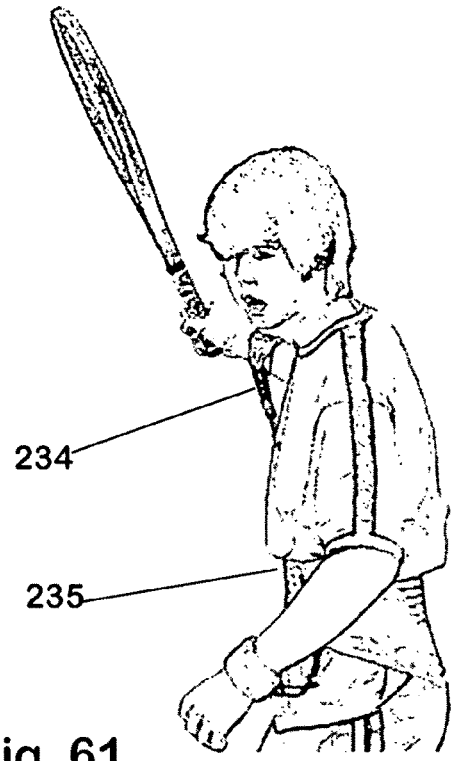
Fig. 61
Fig. 62
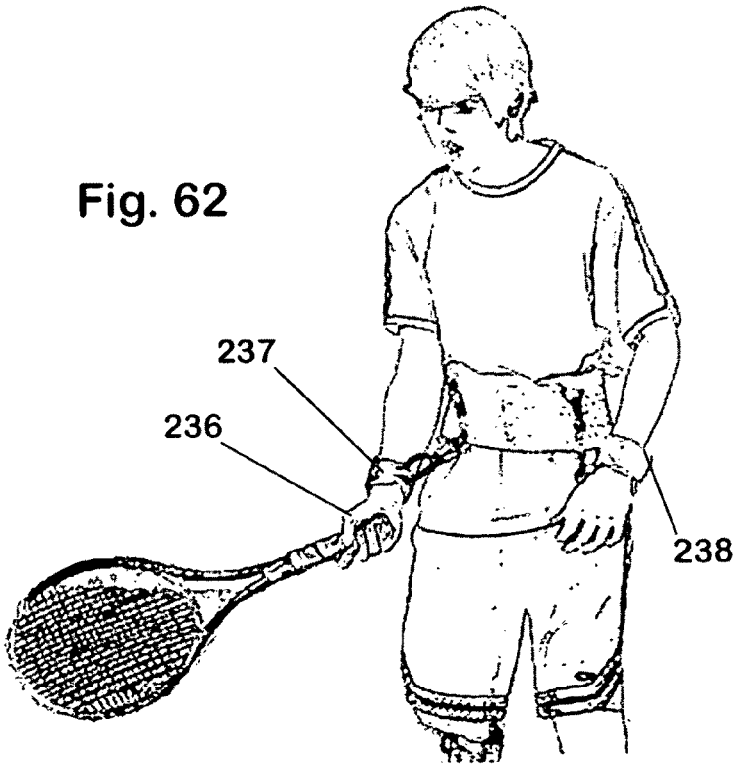

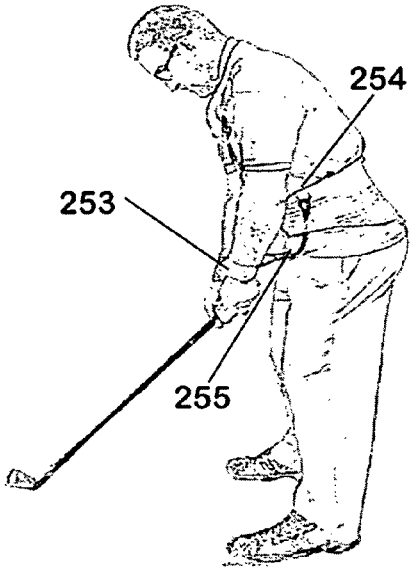
Fig. 71
Fig. 72
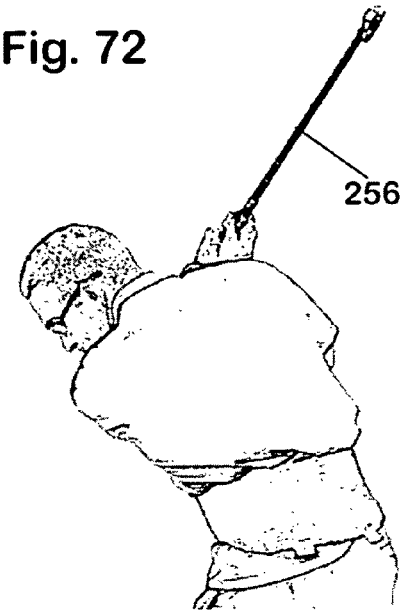
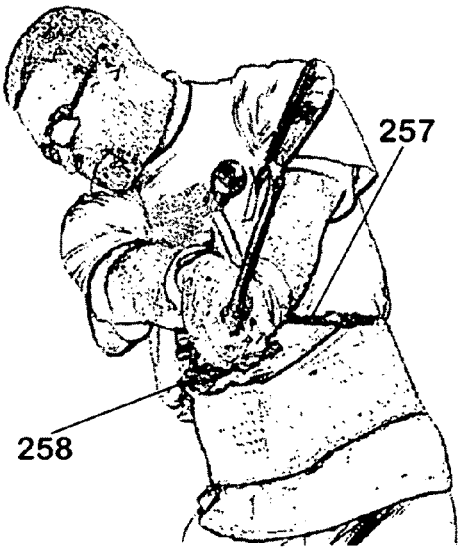
Fig. 73
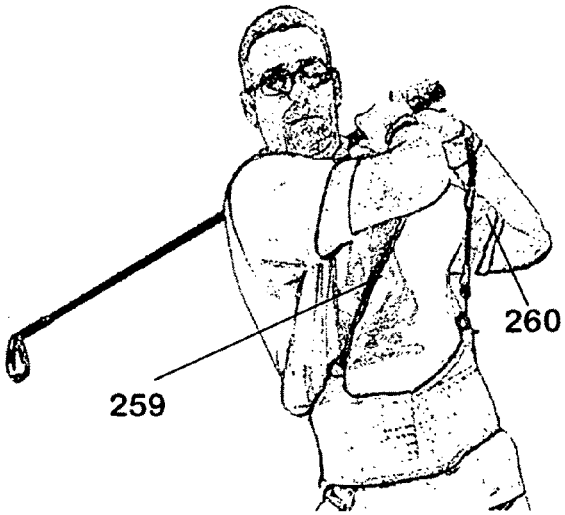
Fig. 74

Chart 1: Force in Kilograms versus Elongation of the Stretch Cord

TRAINING DEVICE FOR PERFORMANCE ENHANCEMENT WITHIN SPORTS

CROSS-REFERENCE TO RELATED APPLICATIONS

This application claims benefit of Provisional Appln. 60/965,949, filed 22 Aug. 2007, the entire contents of which are hereby incorporated by reference as if fully set forth herein, under 35 U.S.C. §119(e).

STATEMENT REGARDING FEDERALLY FUNDED SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Field of the Invention

The present invention relates to devices more specifically for use in sports training in the fields of Baseball, Softball, Golf, Tennis, and other sports requiring control of, and the accuracy of a swing of the arms, the positioning and follow through of the legs, and the positioning of the body when developing its precision and its reactions to moving objects.

Description of the Prior Art

Even as far back as 1892 (U.S. Pat. No. 475,432 W C Blades) inventors have been focused on devices to assist baseball players in gaining control over the various aspects of the sport. This first device was designed specifically to develop control over the pitching of a baseball by relieving the stress on the arm as one developed the pitch. In 1905 one of the first Golfing aides was invented (U.S. Pat. No. 802,623 W C Camp) which restricted the bending of the elbow as the ball is struck. It is claimed that by restricting this movement, the direction of, and power behind the ball could be dramatically improved.

Currently active patents include several different concepts as to how to provide training aides for improving baseball and golf performance. Most of these ideas are restricted to these two sports. Examples include training devices that restrict the movement of the arm (U.S. Pat. No. 5,114,142 G A Gilespie) (U.S. Pat. No. 6,514,163 K C Burns), align and fixed engagement of the head (U.S. Pat. No. 5,174,564 J H Young) (U.S. Pat. No. 5,746,663 M A Calace), devices which align the arm or hands (U.S. Pat. No. 6,231,464 K D Curtis) (U.S. Pat. No. 7,128,658 D A DuFour) and devices which couple movement from arm to arm (U.S. Pat. No. 5,938,548 W Upshaw) (U.S. Pat. No. 6,773,366 J D Gray) (U.S. Pat. No. 6,827,654 I Meyer) (U.S. Pat. No. 6,984,184 J D Gray) or arm to leg (U.S. Pat. No. 5,704,856 B A Morse).

In addition to these simple devices are much more complex mechanical components which improve hand/eye coordination (U.S. Pat. No. 5,954,598 J W Carlson), foot placement and movement (U.S. Pat. No. 5,976,026 G A Erb), measurement of, and quality of the swing (U.S. Pat. No. 6,793,585 M M Kanagawa) (U.S. Pat. No. 7,131,916 T Griffin), and providing resistance training to increase strength (U.S. patent application Ser. No. 10/892,196).

Other devices include an elbow brace (U.S. Pat. No. 6,322,462 T J Kafer), an apparatus used to sense movement when swinging a golf club or baseball bat (U.S. Pat. No. 5,591,089 R W Huffines), a vest with audible alarm to identify completion of a proper swing (U.S. Pat. No. 6,375,581 J M Urban), a device which provides indicia to indicate a triggering movement by the wearer (U.S. Pat. No. 6,918,844 R D Socci) and finally a device "comprising an elongated member of at least a length to extend about the torso of a wearer . . . and a target member slightly secured to the elongated member." (U.S. Pat. No. 6,932,724 R D Socci)

Devices specific to other sports, include the following for basketball. A device which maintains the players elbows in close proximity when making practice shots (U.S. Pat. No. 4,377,284 J Okerlin); a vest worn by the player including a curved guide bar and an elastic sleeve worn over the elbow which guides the players arm through the desired path for making a proper throw of the ball (U.S. Pat. No. 4,383,685 L E Bishop); and "A flexible, adjustable wrist bank which is snugly and non-slippably worn on the shooting arm . . . " (U.S. Pat. No. 4,805,905 G Haub).

Additional devices designed specifically for basketball include: attachments to the arm or hand which improve the shooting of the ball (U.S. Pat. No. 4,919,425 J W Wolf) (U.S. Pat. No. 5,135,217 T C Swain) (U.S. Pat. No. 5,188,356 G H Furr) (U.S. Pat. No. 5,228,682 J W Wolf (U.S. Pat. No. 5,236,190 G K Moss) (U.S. Pat. No. 5,833,233 S Strug) and (U.S. Pat. No. 6,095,936 A M Kirkpatrick). Devices in the literature which restrict the movement of one or both hands in order to "train" the hands and arms to a proper shooting technique (U.S. Pat. No. 5,320,342 S R Houck) (U.S. Pat. No. 5,544,877 N G Brownell) (U.S. Pat. No. 5,816,952 M W Blevins) (U.S. Pat. No. 5,938,547 L G Gilford) (U.S. Pat. No. 6,203,453 D L Coddens) (U.S. Pat. No. 6,283,877 G Cook) (U.S. Pat. No. 6,645,093 M C Sheppard) and (U.S. Pat. No. 7,172,522 C D Harvey).

Devices specific to Boxing include one to "keep an athletes arms and legs in a releasably fixed position adjacent to the athletes torso" (U.S. Pat. No. 5,688,137 W G Bustance) and a hand/wrist stabilization device (U.S. Pat. No. 6,013,044 J J Estwanik).

A Softball pitching aid is described which mounts to the hips and thighs including a number of fasteners for selectively attaching one or more training bands. The device is used to control hip rotation during the pitching of the ball. (U.S. Pat. No. 5,803,881 W J Miller)

Most training devices for Tennis are designed to reduce the effects of Tennis Elbow. As those devices are not covered within the scope of this application, they will not be noted here. Training devices not related to tennis elbow include a device for "assisting a trainee in stroking a tennis racket in such a manner that the head of the tennis racket does not shift in the vertical plane below the wrist . . . " (U.S. Pat. No. 3,937,465 B Roland); a rigid device for teaching the proper wrist position (U.S. Pat. No. 4,445,686 J C Daugherty) (U.S. Pat. No. 4,519,608 P E Gilly) (U.S. Pat. No. 5,476,257 A Bobby); A device that couples the wrists together in order to move the arms together in order to train the player to turn the shoulders and twist the body (U.S. Pat. No. 5,005,833 J E Groveman); and a device which couples the racket to the players wrist in order to prevent the player from bending or flexing the wrist (U.S. Pat. No. 5,618,040 C G Parten).

A volleyball training device involves a waistband and wrist strap that are connected together with a tether that restricts the movement of the arm as required by some volleyball shots (U.S. Pat. No. 5,165,696 C D Saha) and an adjustable set of straps to teach and practice the proper body position while passing or moving to pass a volleyball (U.S. Pat. No. 5,460,385 D Lazzeroni).

BACKGROUND

As evidenced by the discussion of the prior art, there have been a multitude of attempts to develop acceptable training aids for the development of improved performance in virtually all sports. By analyzing these attempts and understanding the limitations derived in each, along with extensive testing of new concepts as to how to successfully improve performance, the heretofore discussed technology has evolved, providing a dramatic solution that has resulted in a universal trainer that dramatically improves the athletes' performance.

BRIEF SUMMARY OF THE INVENTION

The invention relates to a sports training device which is used to improve the amount of power, and placement of that power, when making contact with, or delivering a ball or other object into play.

Whether delivering the power to a bat, racquet, hand, or foot, the heretofore described sports training device provides the proper attitude and motion to the players' attack of the item being put into play and thus providing unparalleled performance. Just a few reps a day with the training device provides toning and eventually memory to the players musculature that results in a significant increase in performance.

Important to the concept is the location of the pivot point or "center of action" associated with the muscular control developed when using this device. By attaching the resistance bands at the waist, proper control and muscle development relating to improved performance is accomplished.

The device includes a wide belt made of stretchable fabric that fits snugly around the waist and closes with an adjustable Velcro closure system. The Velcro is wide enough and long enough to be adjustable to a wide variation of players' physiques. Attached to the belt are several side release buckles that allow the connection of wrist straps, foot straps, or other control devices used to control the swing and follow through of the player, through initialization of the swing, contact with the ball, and finally follow through and completion of the swing.

The attachable devices include an adjustable length in order to optimize the device to the player on which it is being used. These devices may also include adjustable wrist straps, foot straps, or other attachments as required for the exercise being performed.

BRIEF DESCRIPTION OF THE SEVERAL VIEWS OF THE DRAWING(S)

Having just described the invention in general terms, other and further objects, features, and advantages of the invention will be made more explicit from the following detailed description taken with reference to the drawings, which are not necessarily drawn to scale.

FIG. 1 A flat view of the front side of the belt

FIG. 2 An Isometric exploded view of the belt indicating the first step in its assembly.

FIG. 3 An isometric view of the belt showing the placement of the buckles with straps during assembly of the belt.

Figure 6:
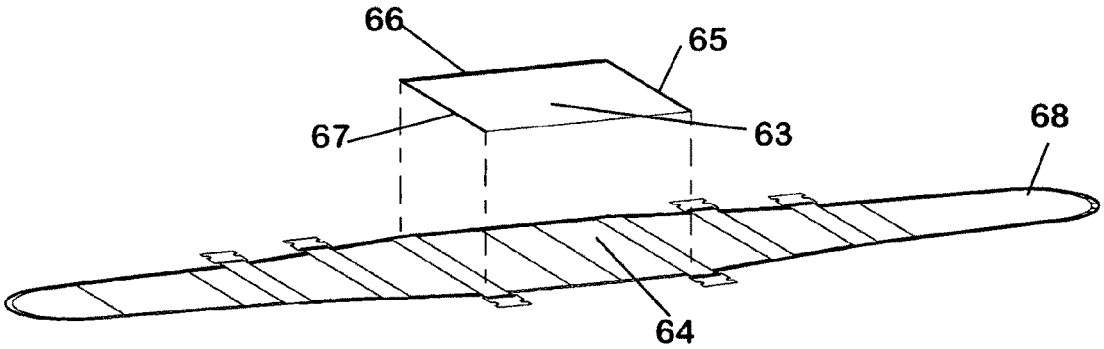

FIG. 6 Indicates the assembly of the pocket to the back side of the belt.

Figure 7:
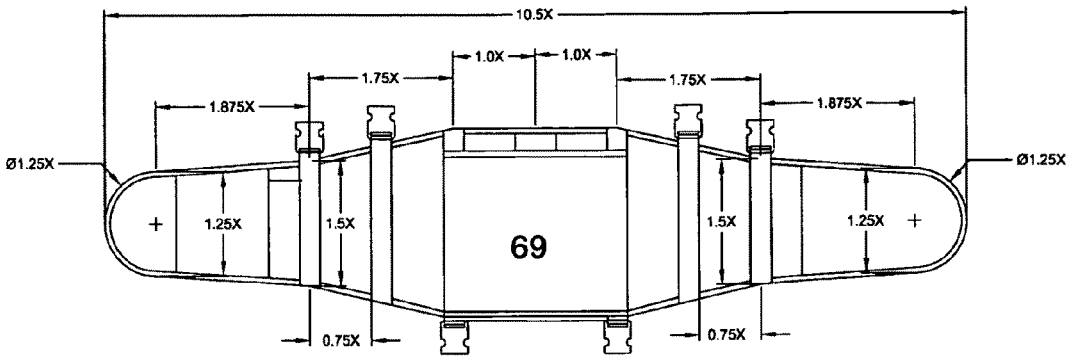

FIG. 7 Indicates the relative dimensions of the belt based on some value "X".

Figure 8:
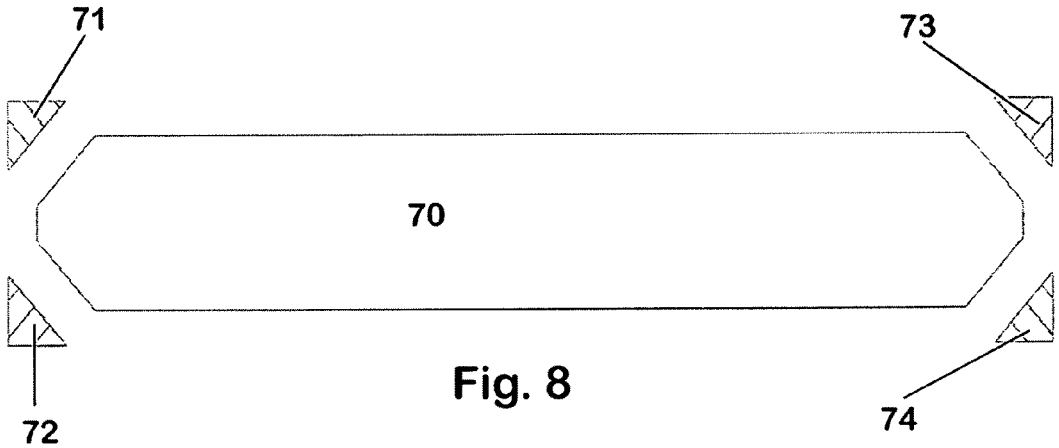

FIG. 8 Indicates the beginning of the fabrication of the wrist strap whereby the corners of a smooth ribbon like material are trimmed off.

Figure 9:
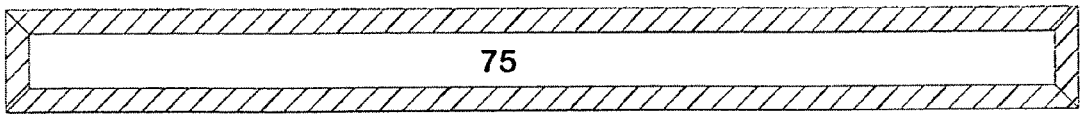
Figure 10:
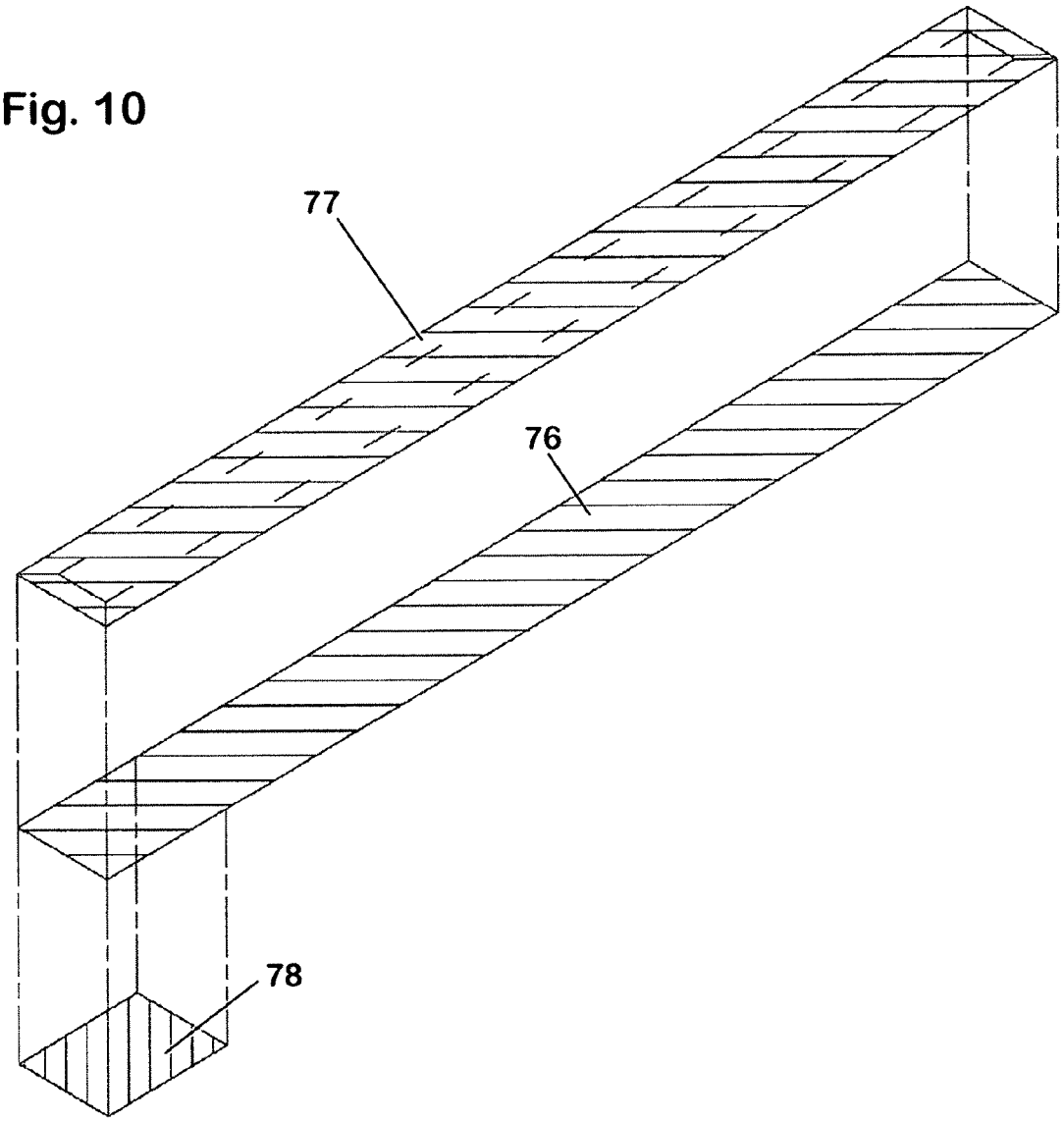

FIG. 9 The outer edges of the trimmed ribbon material are folded over in order to begin assembly of the wrist strap FIG. 10 An isometric view of the initial assembly of the wrist strap.

Figure 11:
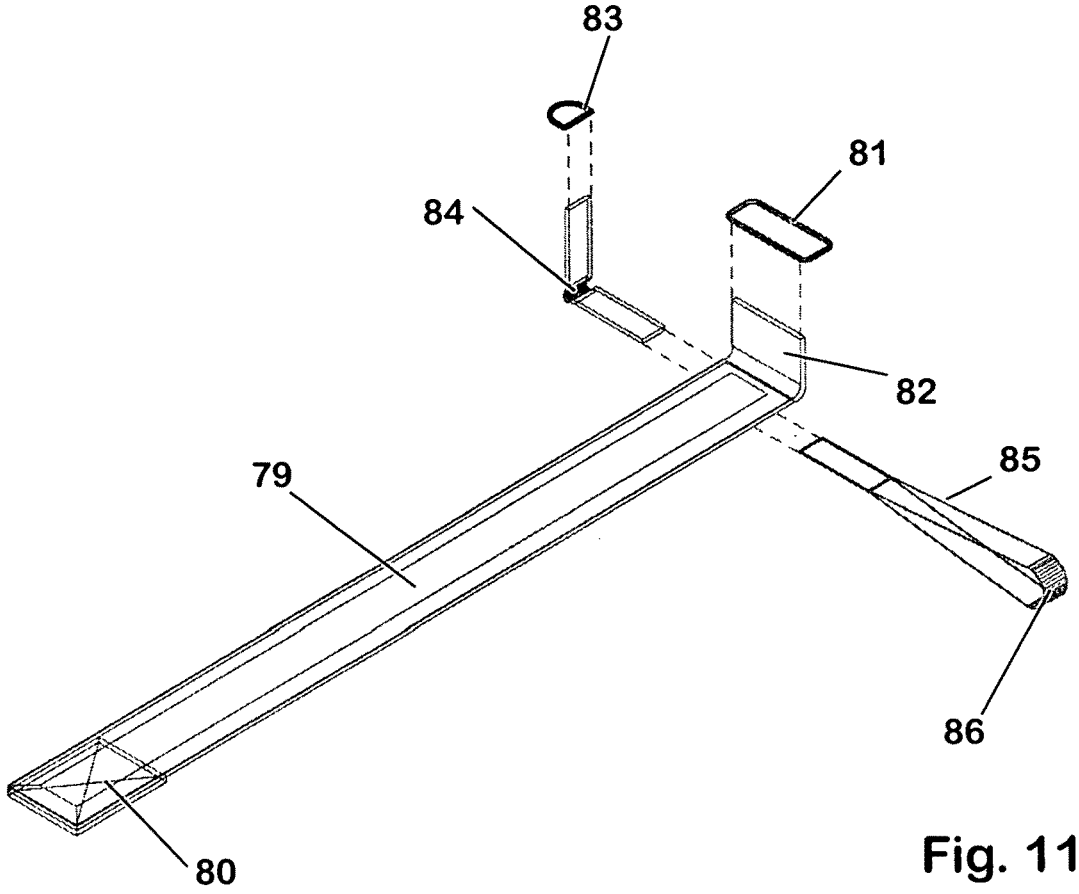

FIG. 11 The addition of components to the wrist strap assembly.

Figure 12:
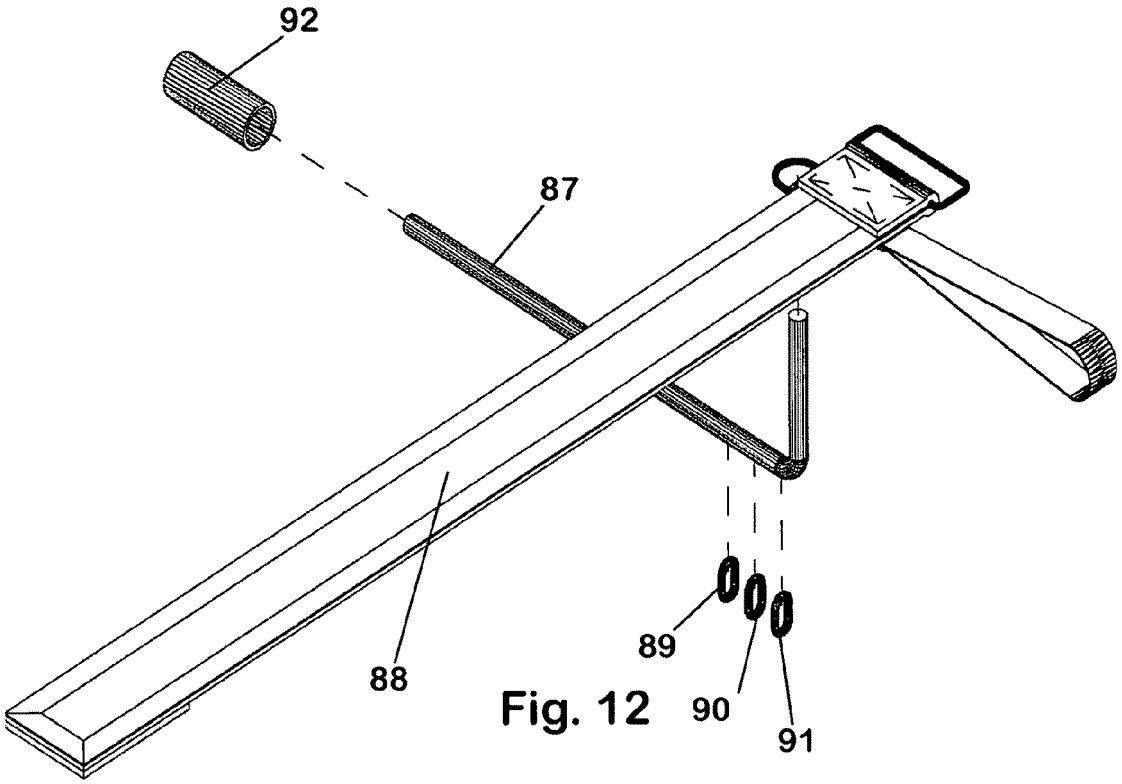

FIG. 12 The further addition of an elastic cord to the wrist strap.

Figure 13:
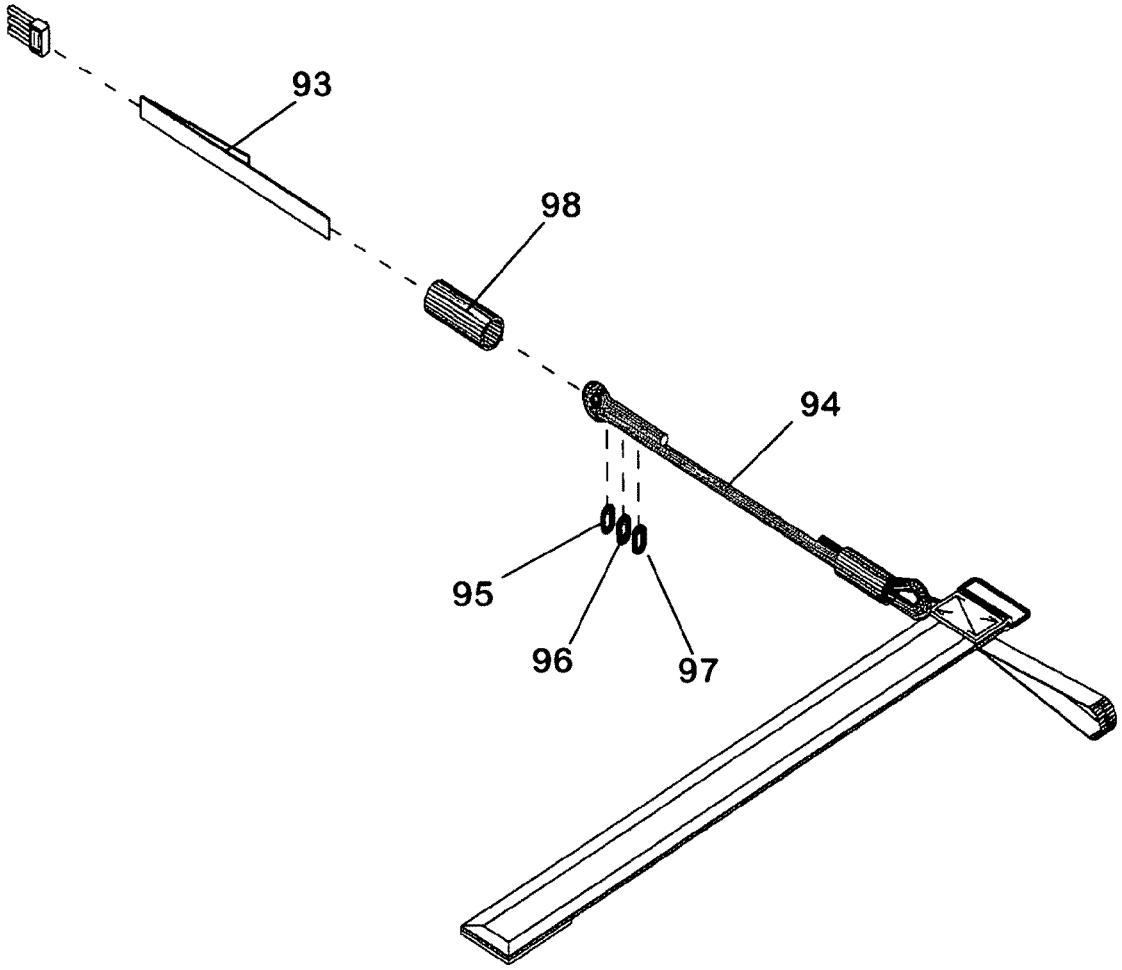

FIG. 13 The finishing of the wrist strap through the addition of a male quick release connector attached to a length of webbing.

Figure 14:
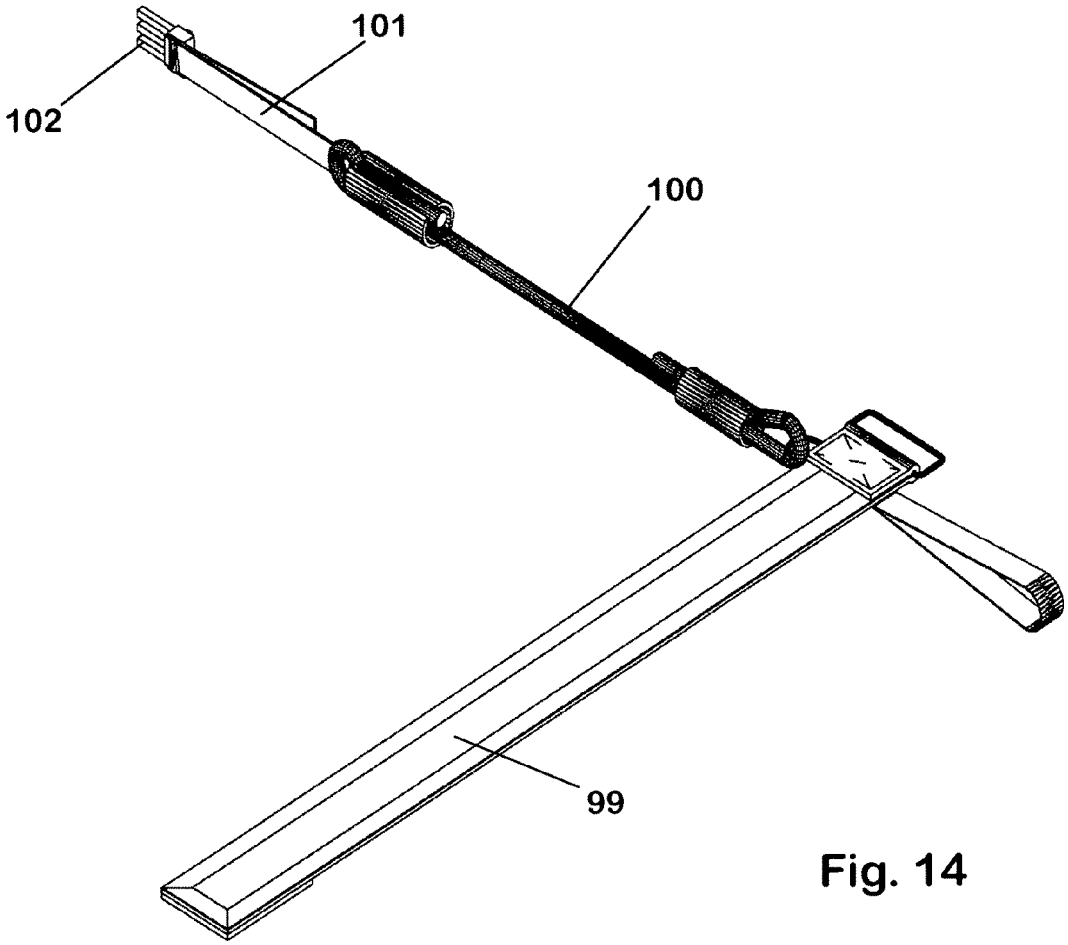

FIG. 14 An isometric view of the completed wrist strap.

Figure 15:
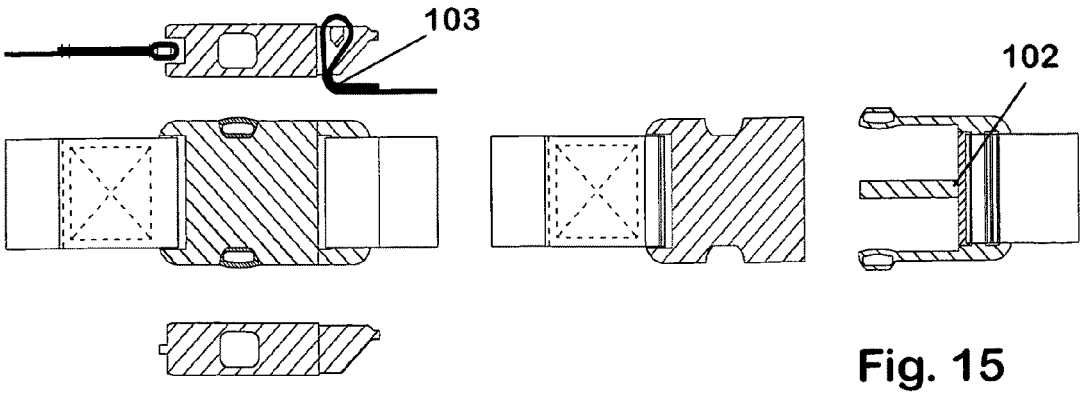

FIG. 15 A diagram indicating the proper installation of the male quick release connector to the webbing material.

Figure 16:
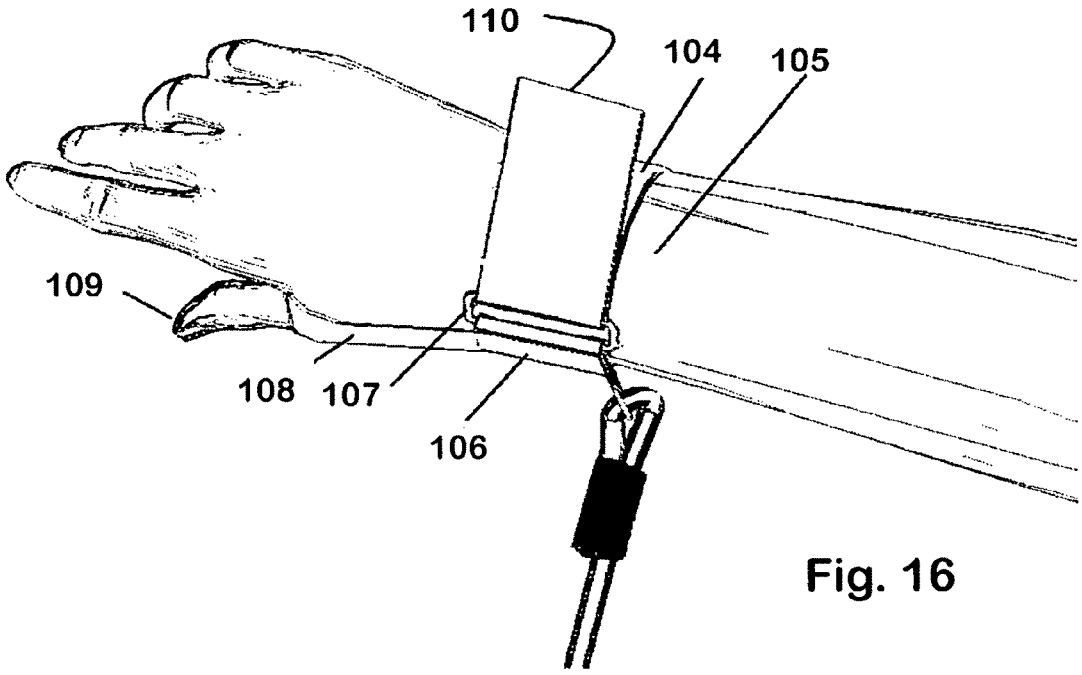

FIG. 16 A rendering of how the wrist strap is installed on the wrist of the player when using the belt.

Figure 17:
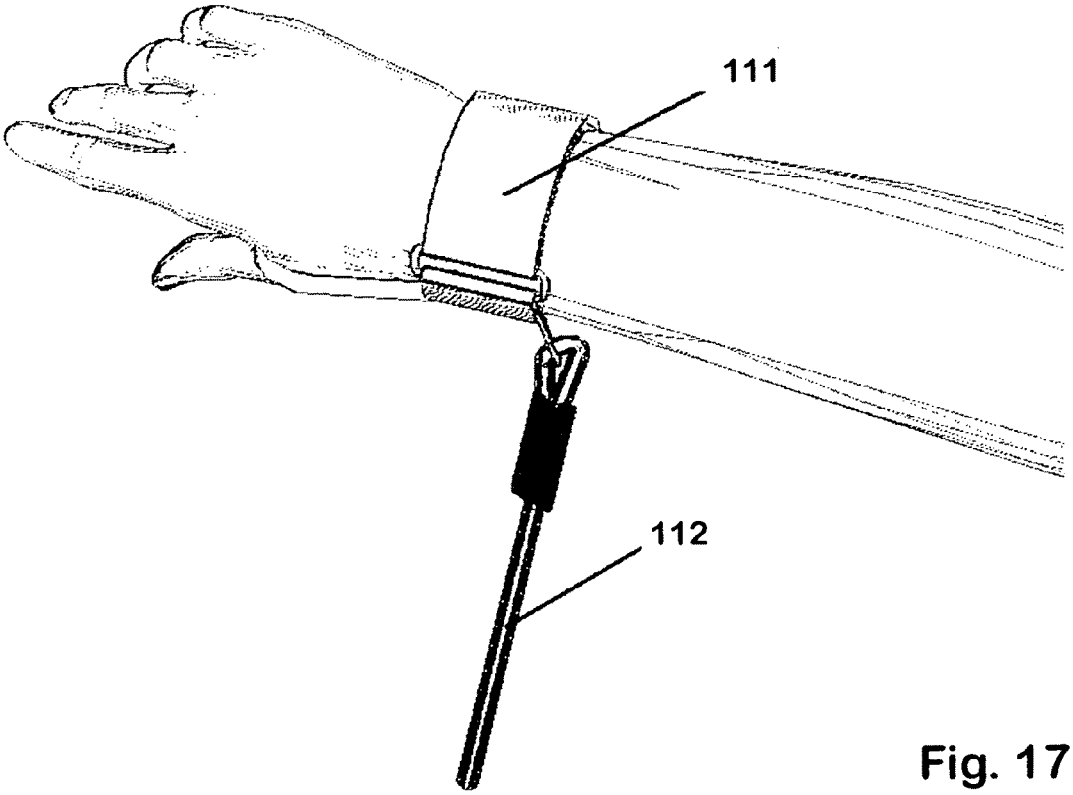

FIG. 17 A rendering showing final closure of the wrist strap on the wrist of the player using the wrist strap.

Figure 18:
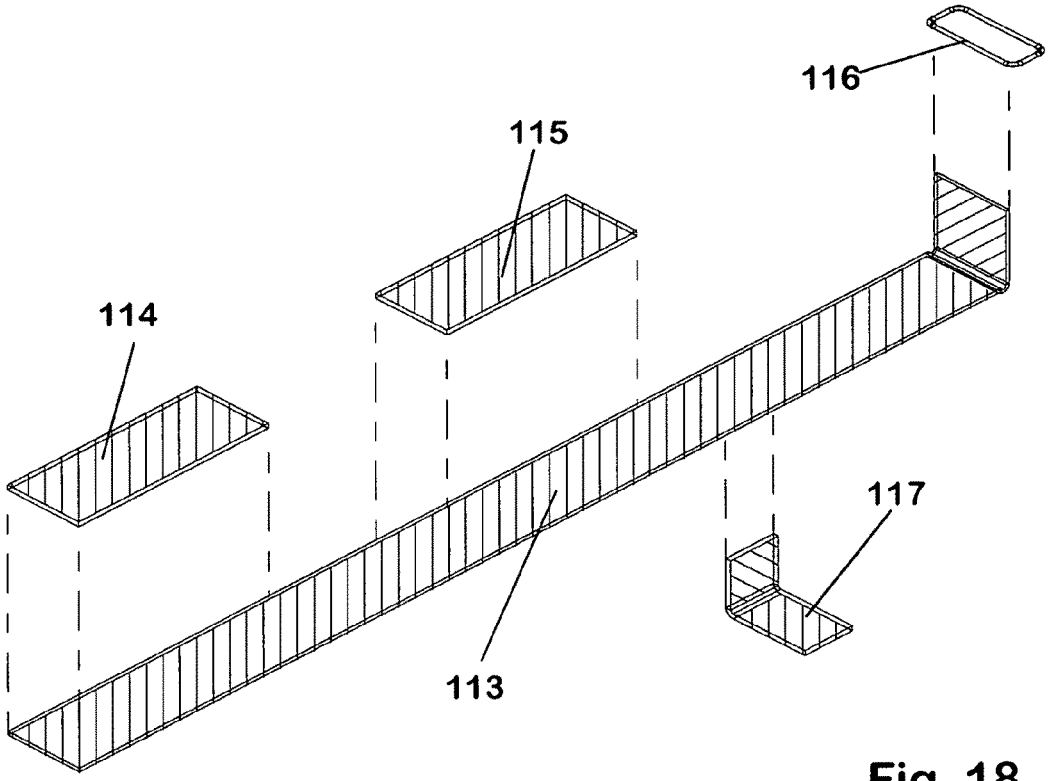

FIG. 18 An isometric view of the initial assembly of the foot strap.

Figure 19:
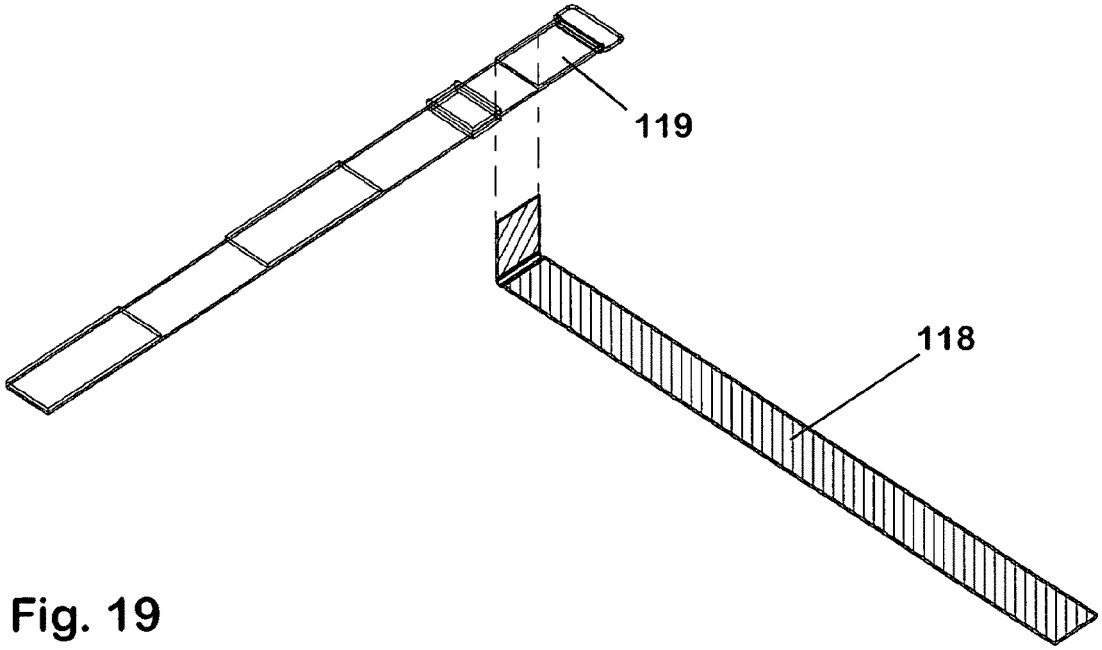

FIG. 19 The addition of the strap that goes under the player's shoe.

Figure 20:
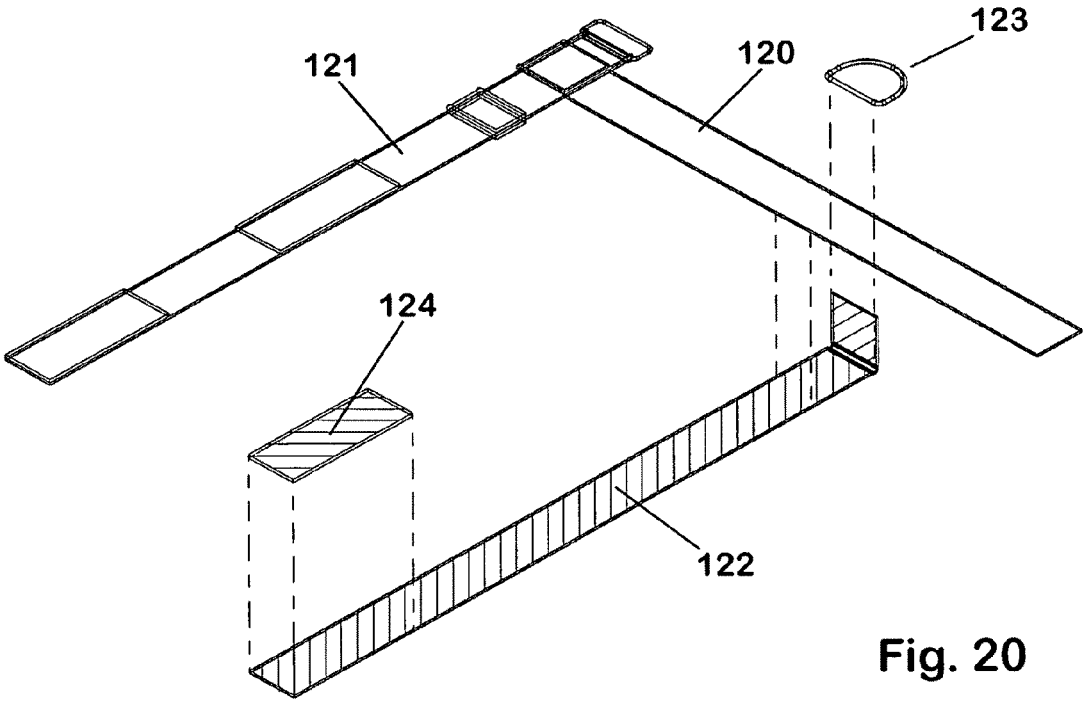

FIG. 20 The further addition of a strap to the strap added in FIG. 19.

Figure 21:
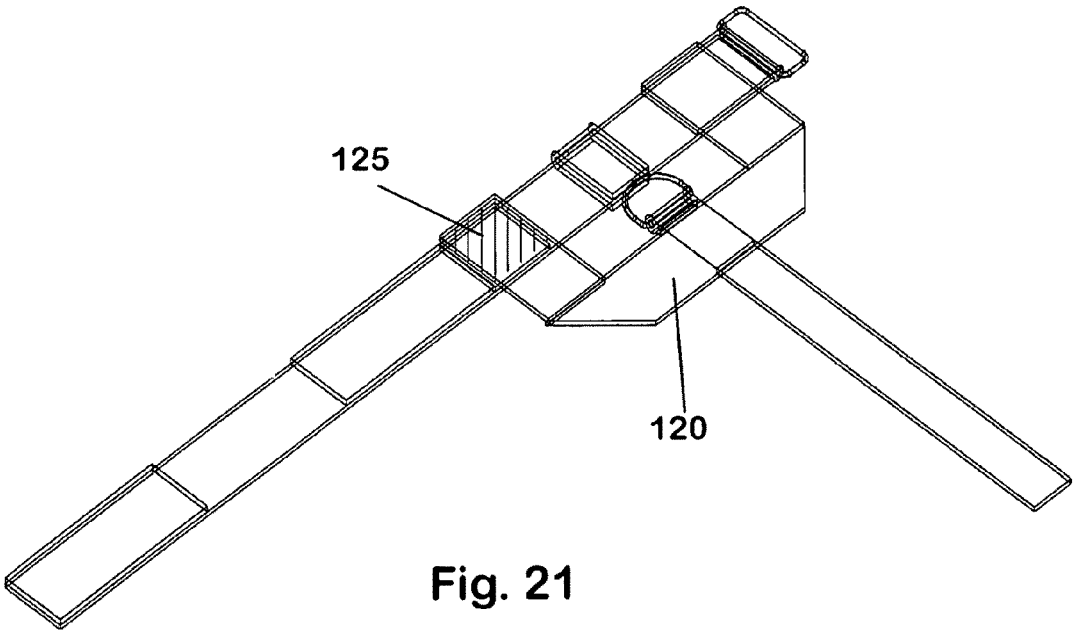

FIG. 21 The final placement and securing of the strap attached in FIG. 19.

Figure 22:
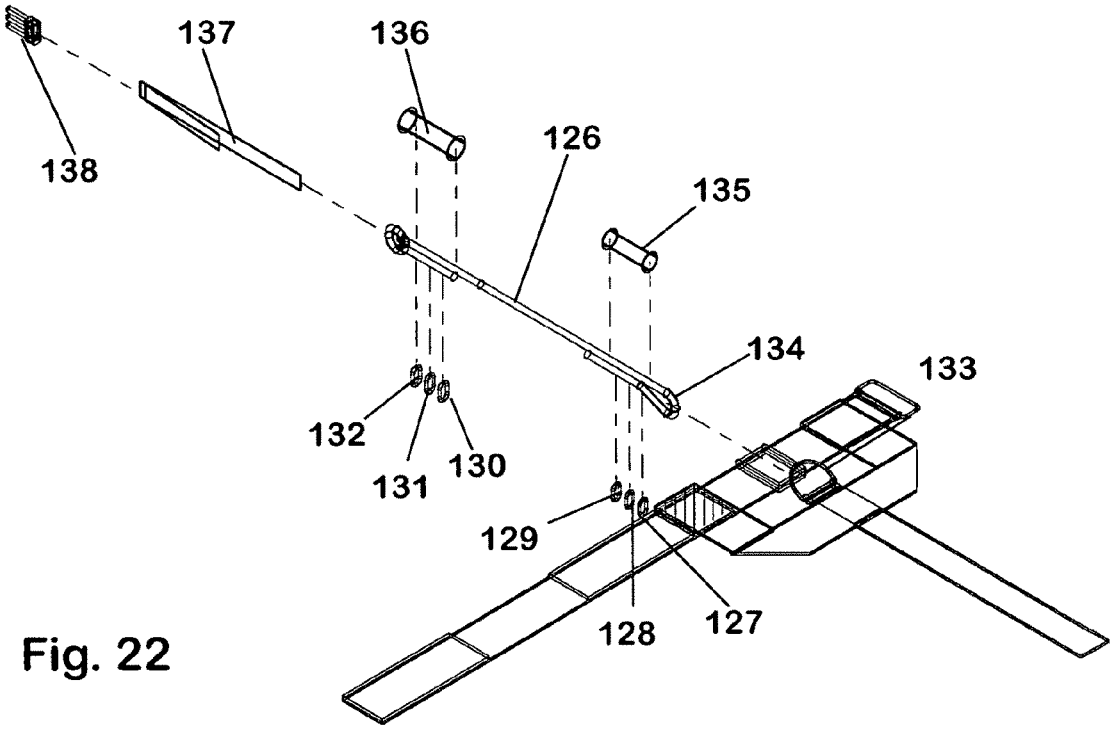

FIG. 22 The makeup of an elastic strap that is attached to the D-Ring shown in FIG. 21.

Figure 23:
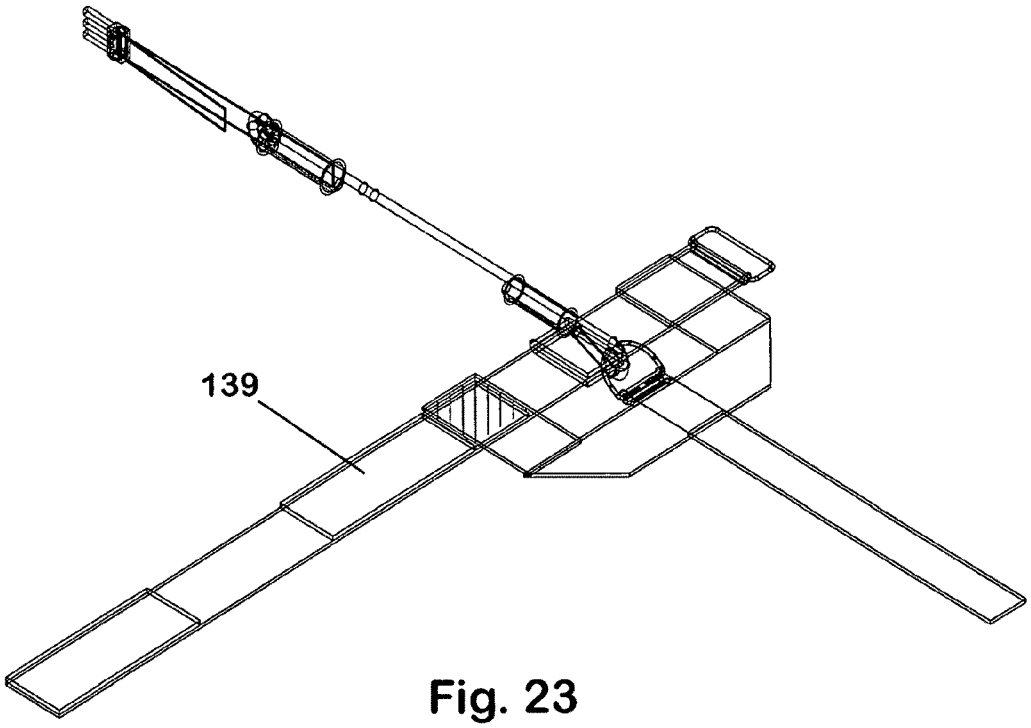

FIG. 23 An illustration of the final foot strap assembly.

Figure 24:
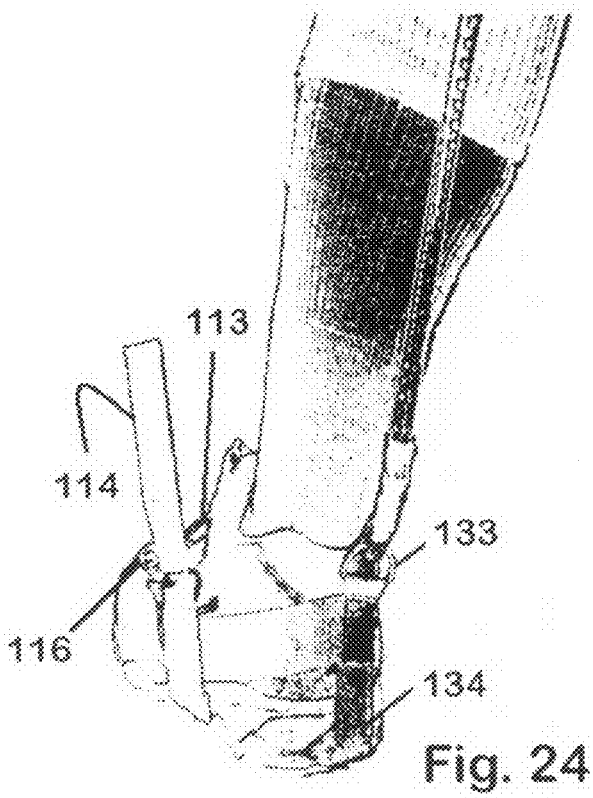

FIG. 24 A rendering of how the foot strap is properly installed on the player's shoe.

Figure 25:
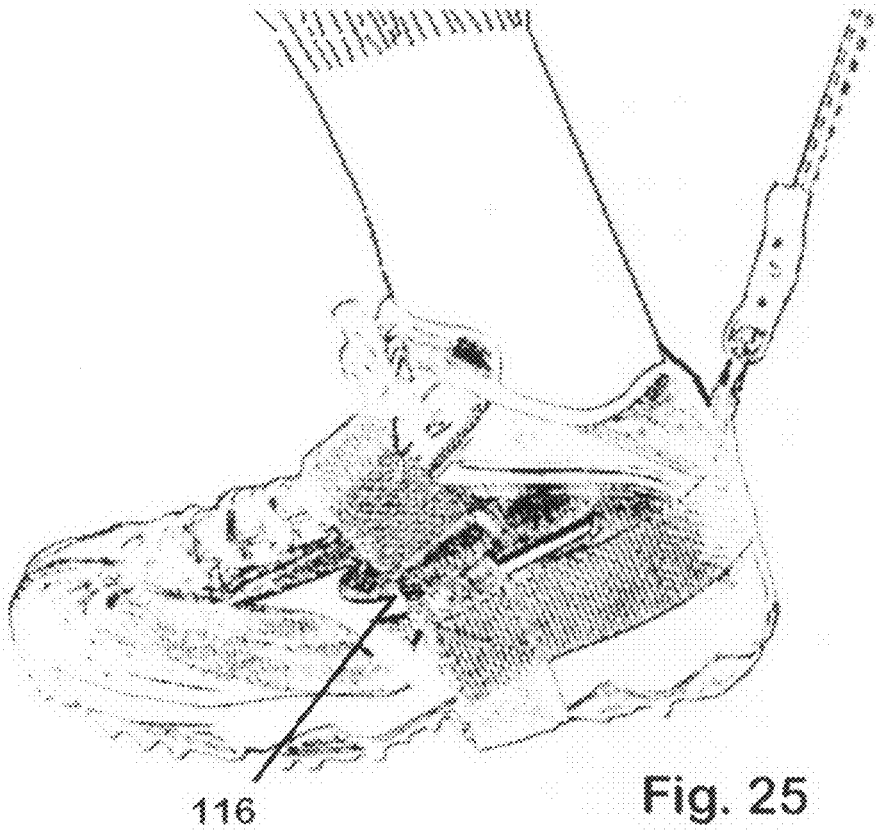

FIG. 25 A side view of the foot strap properly assembled to the players shoe.

Figure 26:
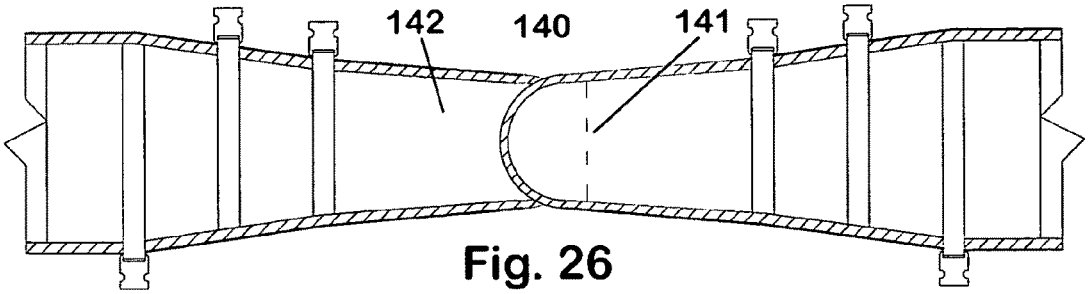

FIG. 26 A front view of the belt closure whereby the hook material on the back of the belt is brought around front and secured over the loop material on the front of the belt. This illustration shows the maximum diameter for the closure of the belt. The illustration has been separated at the back side of the belt in order to provide clarity to the front closure perspective.

Figure 27:
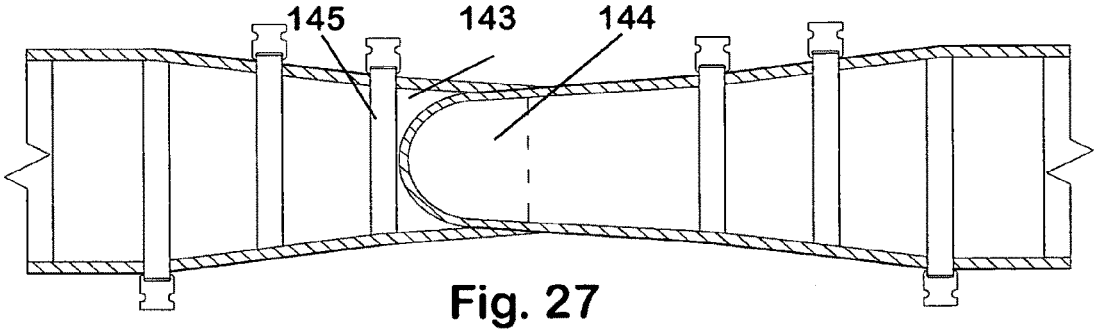

FIG. 27 An alternate front view of the belt illustrating closure providing a minimum diameter for closure of the belt.

Figure 28:
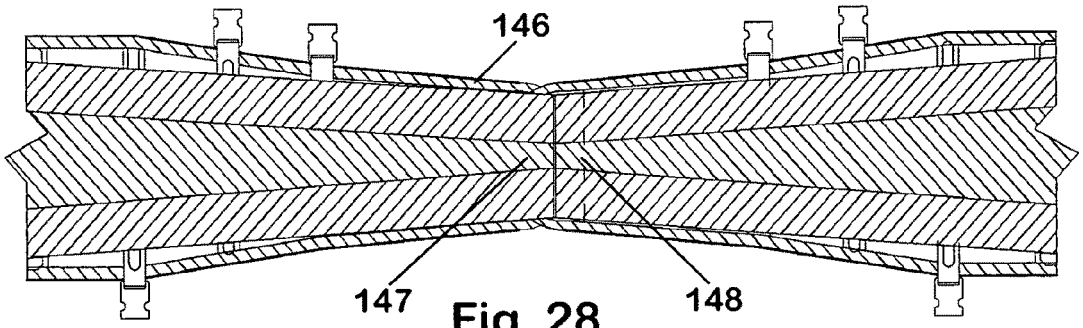

FIG. 28 After closure of the belt, the stretch material is brought around and secured to the front of the belt. This illustration illustrates closure of the belt when the diameter of the belt is at its maximum diameter.

Figure 29:
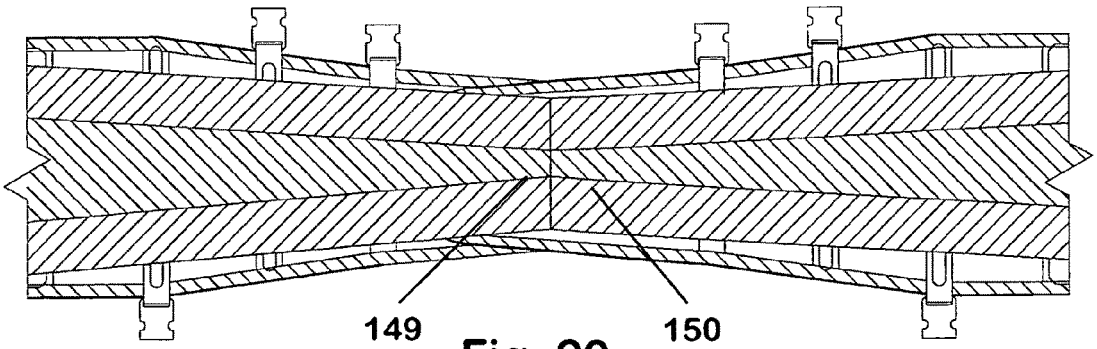

FIG. 29 This diagram illustrates closure of the stretch material when the diameter of the belt is at its minimum. Note that the stretch material still closes at the midpoint of the belt closure.

Figure 30:
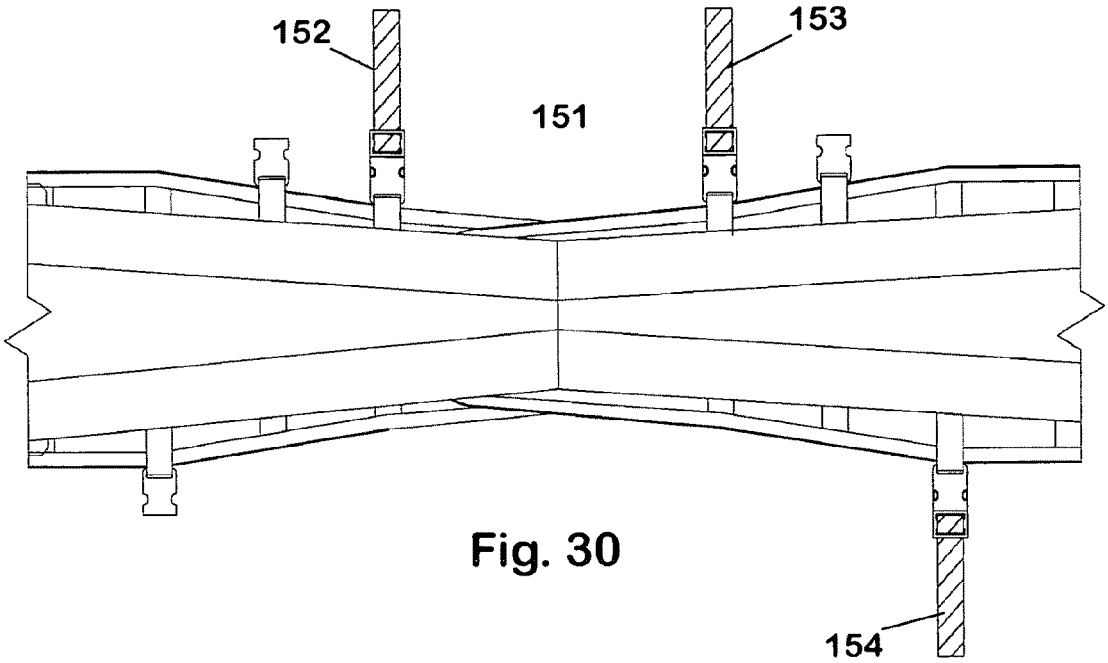

FIG. 30 When connecting the wrist straps and foot straps to the belt, the indicated configuration is for a left-handed hitter, tennis player, or golfer.

Figure 31:
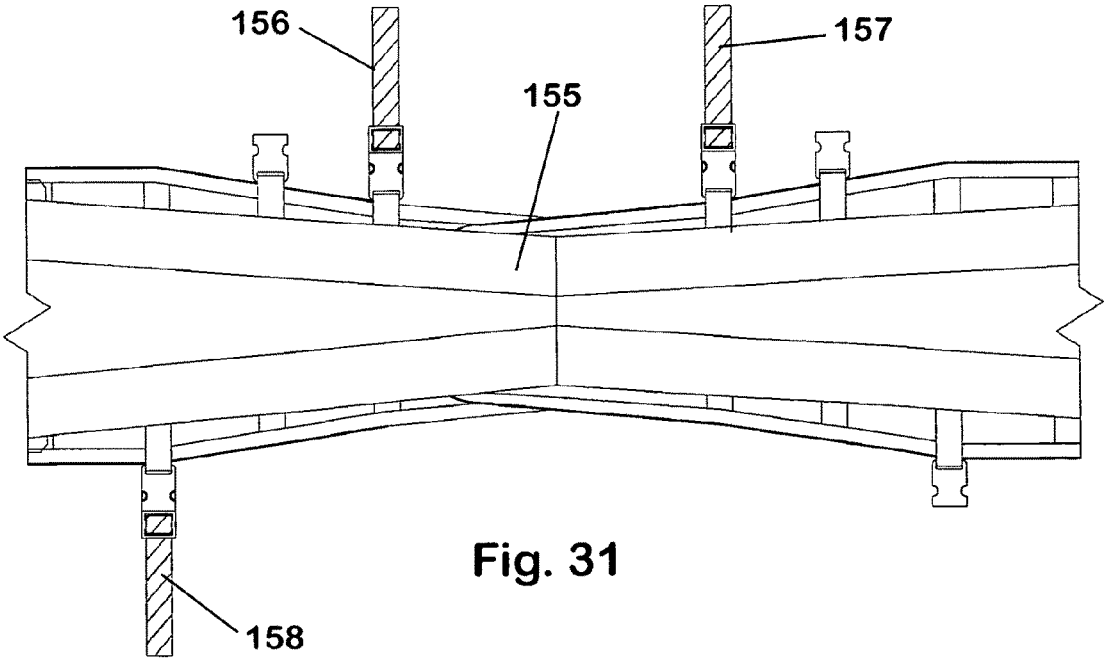

FIG. 31 When connecting the wrist straps and foot straps to the belt, the indicated configuration is for a right-handed hitter, tennis player, or golfer.

Figure 32:
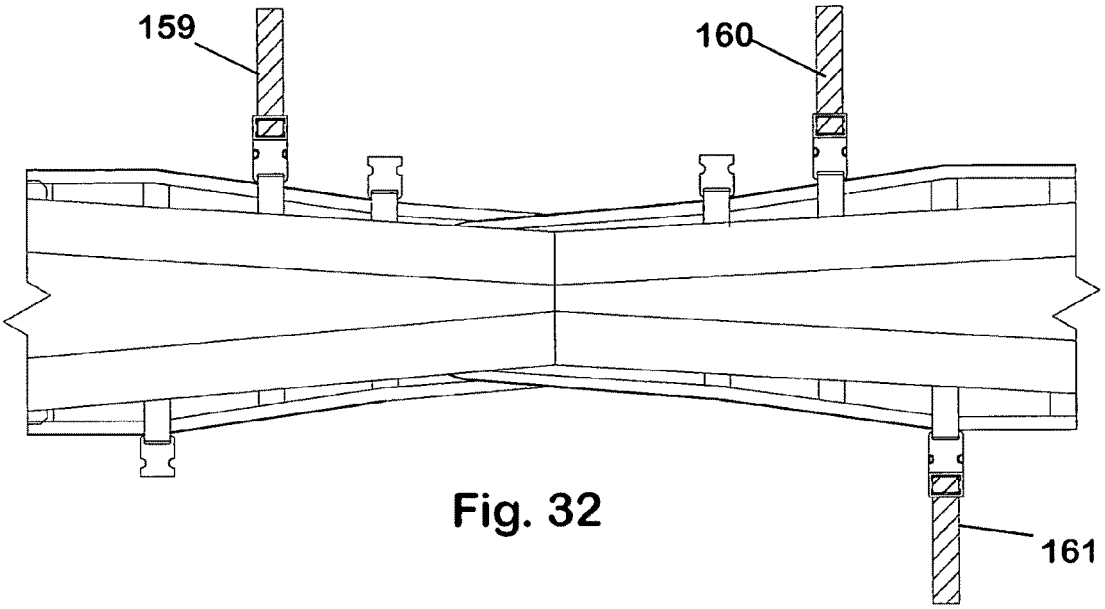

FIG. 32 When connecting the wrist straps and foot straps to the belt, the indicated configuration is for a left-handed Pitcher.

Figure 33:
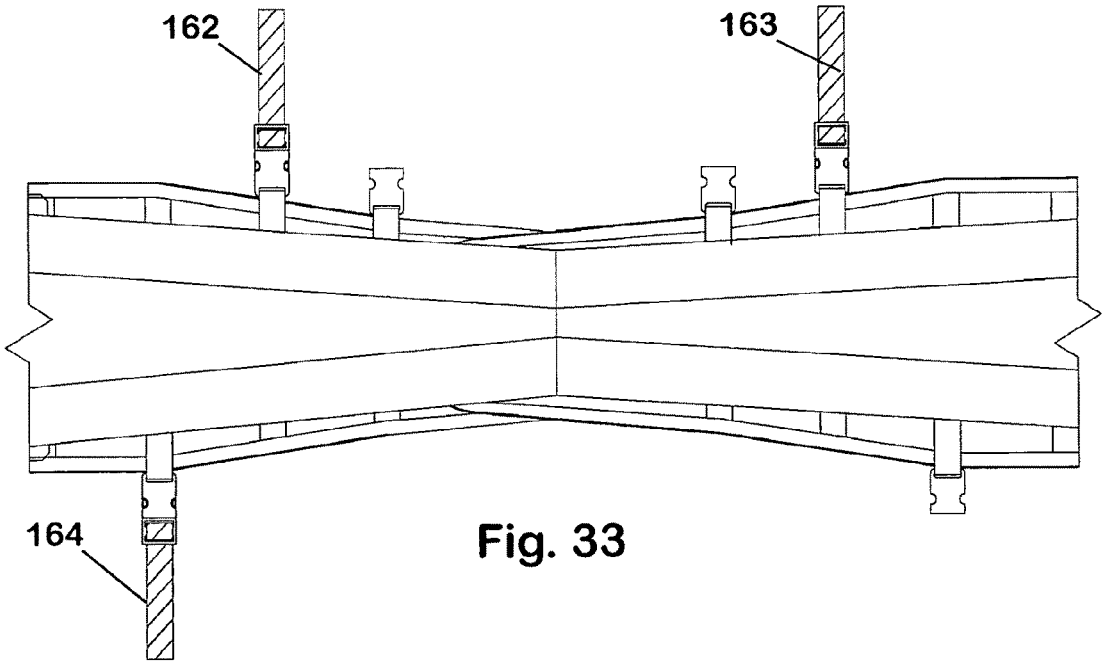

FIG. 33 When connecting the wrist straps and foot straps to the belt, the indicated configuration is for a right-handed Pitcher.

Figure 34:
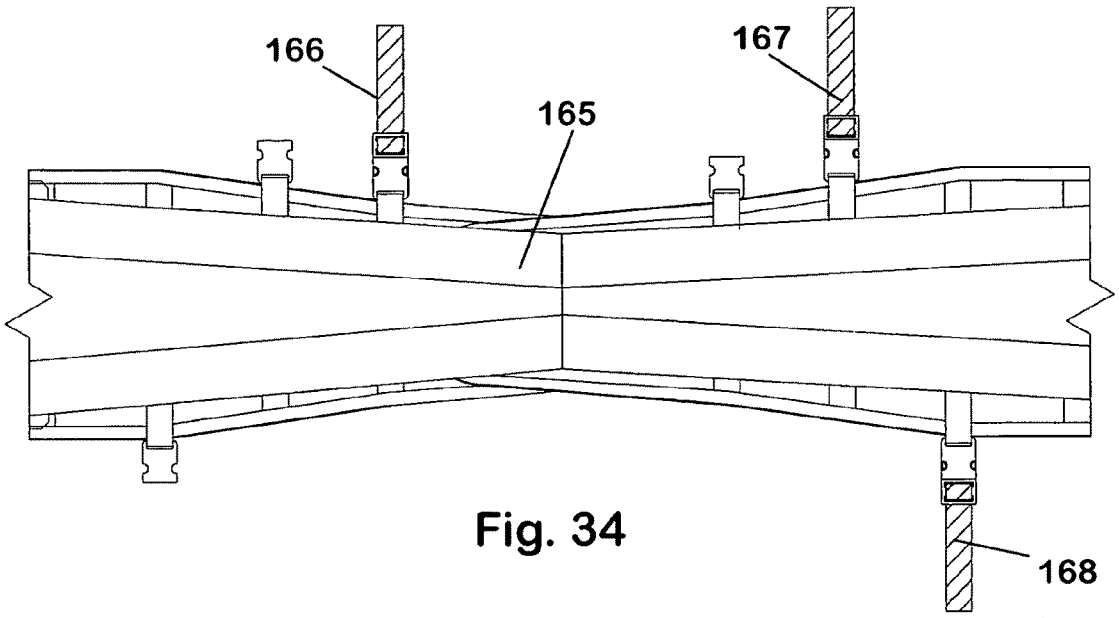

FIG. 34 When connecting the wrist straps and foot straps to the belt, the indicated configuration is for a left-handed fielder.

Figure 35:
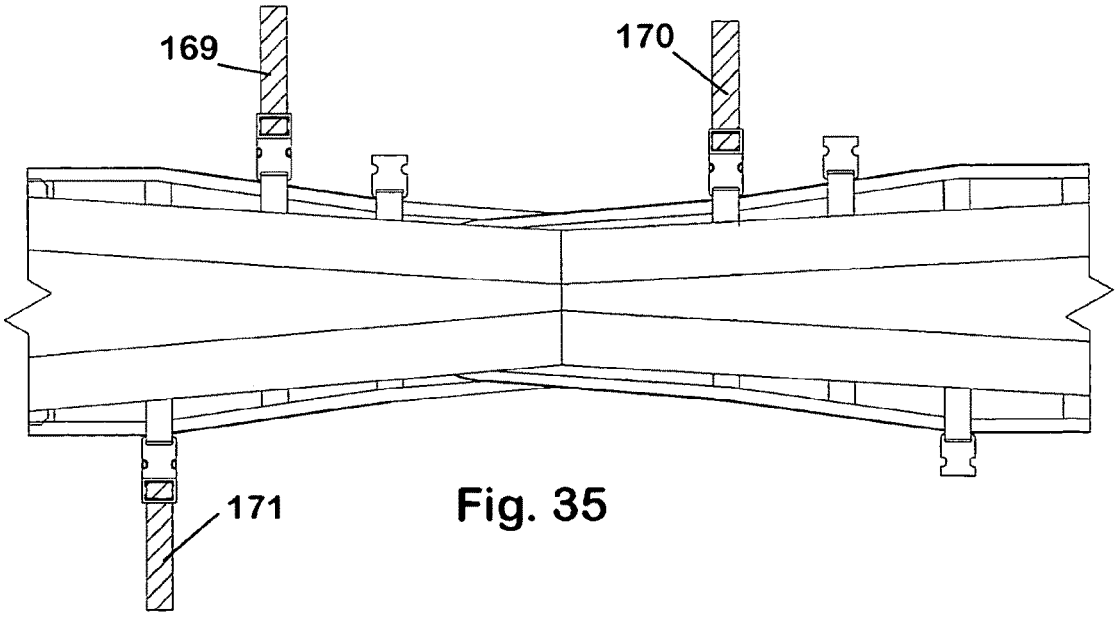

FIG. 35 When connecting the wrist straps and foot straps to the belt, the indicated configuration is for a right-handed fielder.

Figure 36:
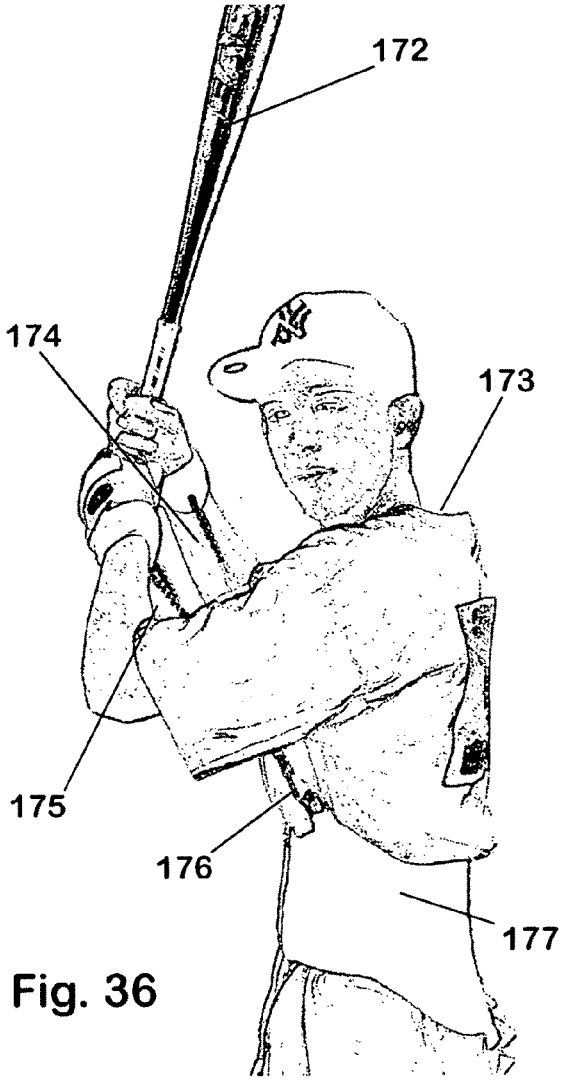

FIG. 36 A baseball player with the wrist straps installed, the arms brought back to the "hand slot" waiting for the pitch.

Figure 37:
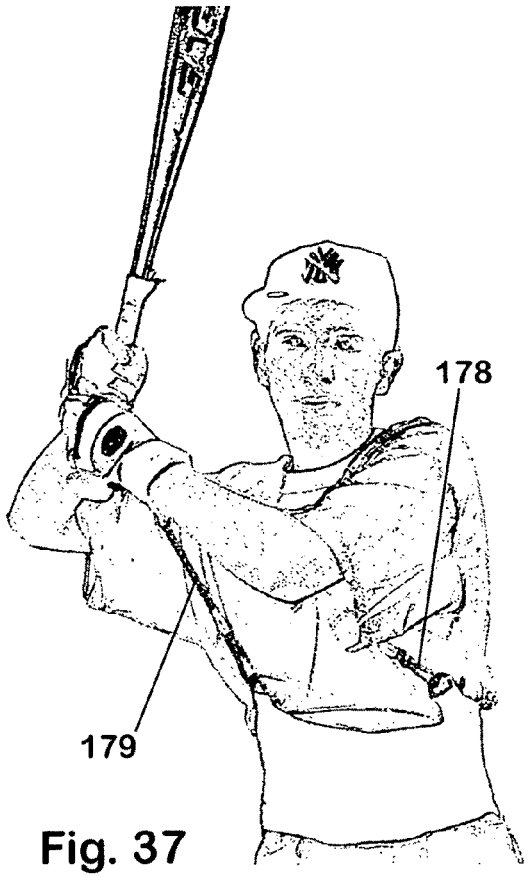

FIG. 37 The rotation or pivot position.

Figure 38:
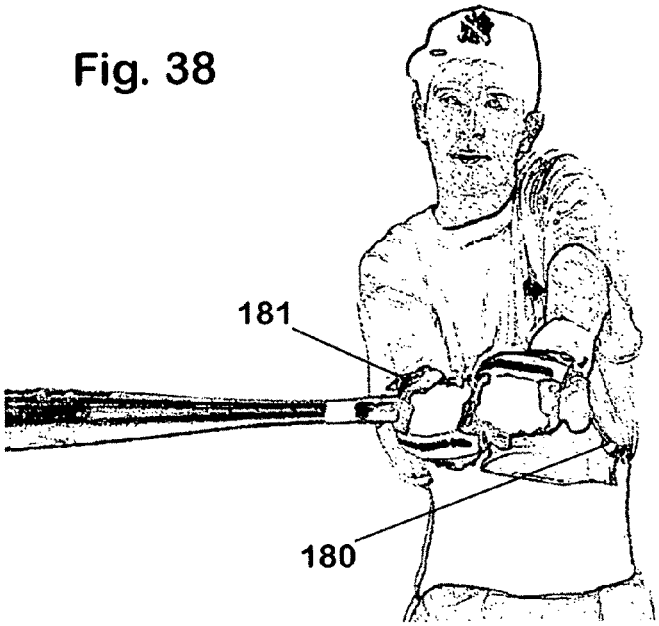

FIG. 38 The batter swings forward to the "contact" position.

Figure 39:
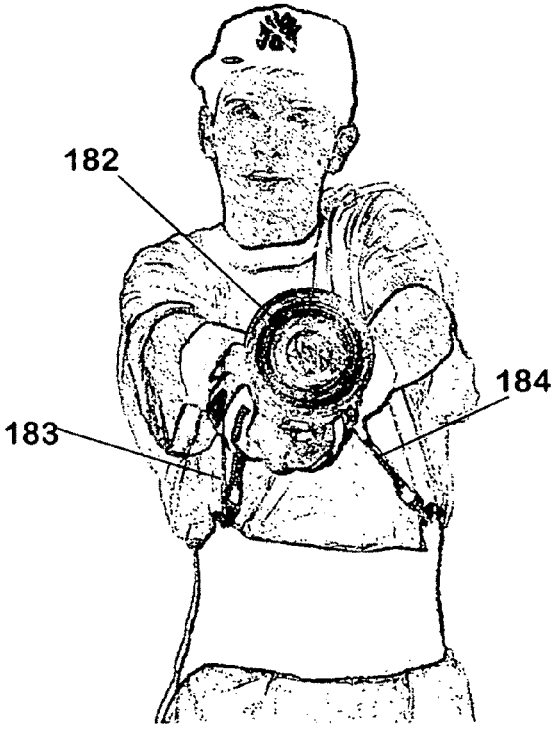

FIG. 39 After contact with the ball, the batter follows through to the "extension" position.

Figure 40:
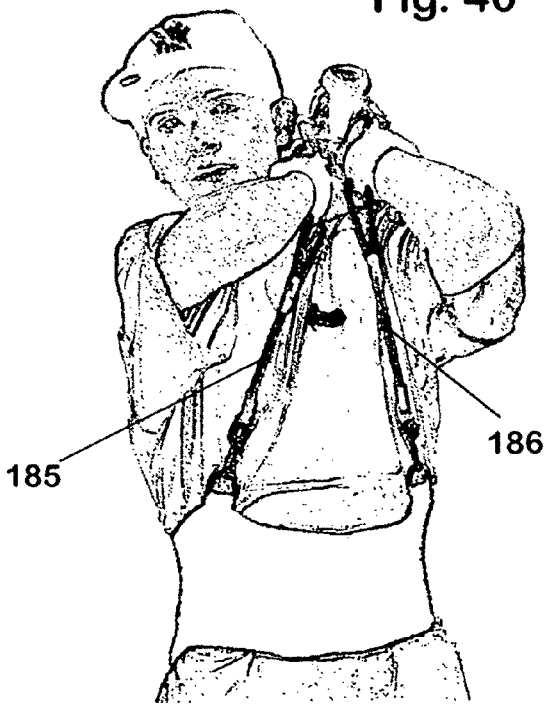

FIG. 40 Finally, the batter goes to the "follow through" with the bat ending up over his/her shoulder.

Figure 41:
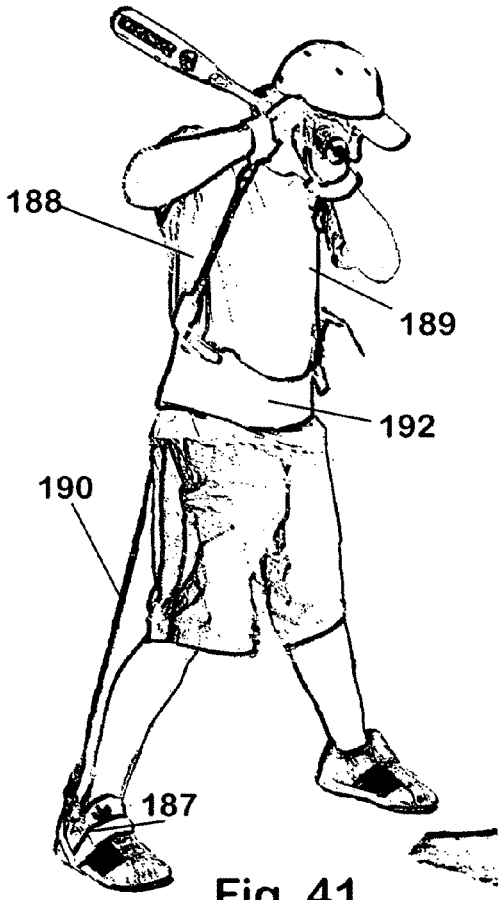

FIG. 41 Illustrates how the foot strap is used during hitting exercises; the hand slot.

Figure 42:
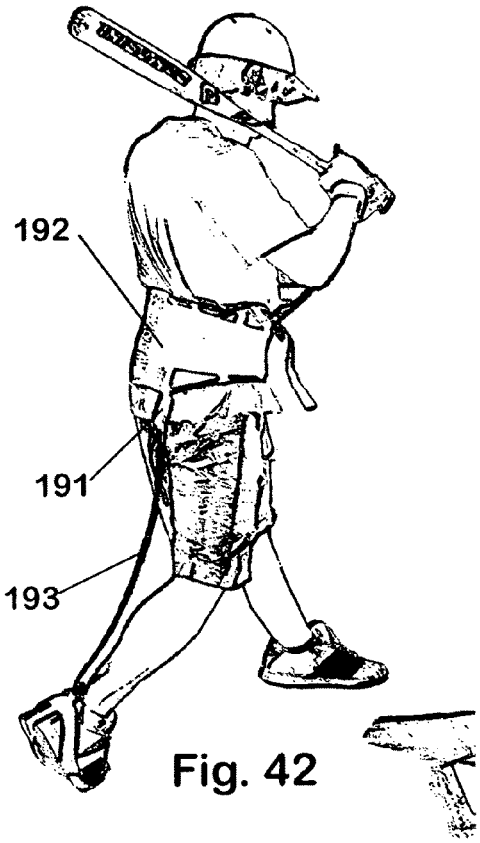

FIG. 42 The foot strap as seen in the pivot position.

Figure 43:
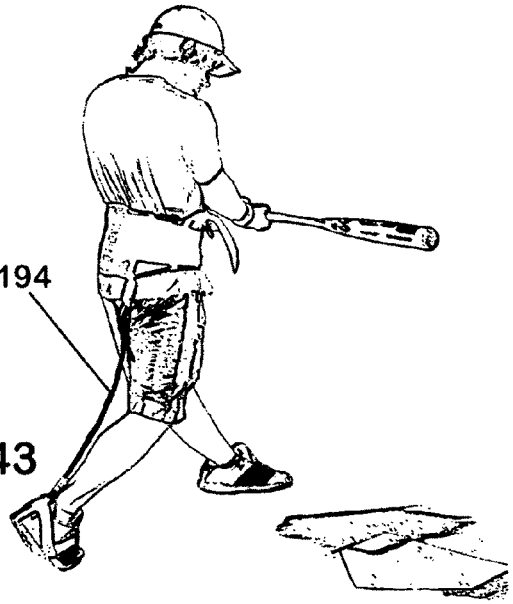

FIG. 43 The foot strap as seen during the contact.

FIG. 44 The foot strap During the extension.

FIG. 45 The foot strap in the follow through.

FIG. 46 The pitcher begins the procedure in the "setup" position.

FIG. 47 The pitcher using the belt in the "balance" position.

FIG. 48 The "separation" position.

FIG. 49 The pitcher transitions into his "rotation" phase.

FIG. 50 As the pitcher goes to his "finish" position, his body is at full extension.

Figure 51:
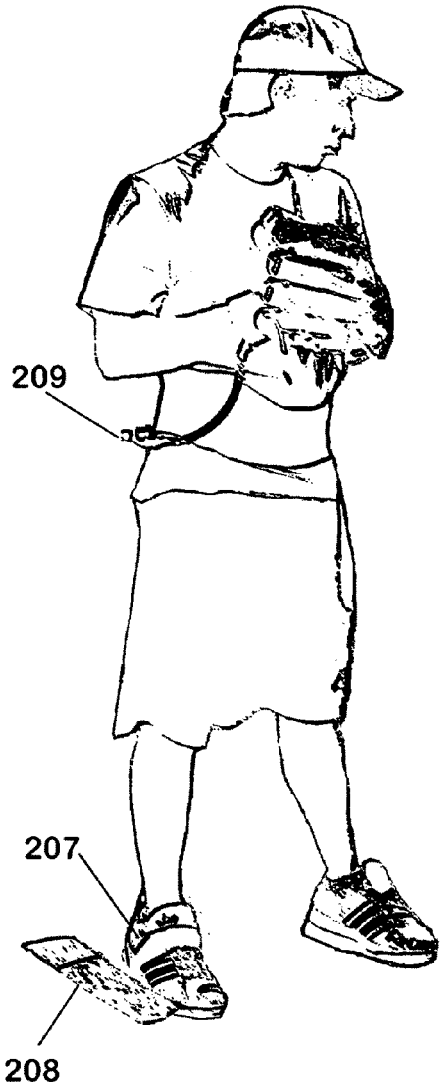

FIG. 51 A side view of the "setup" showing the pitcher with wrist straps and a foot strap.

Figure 52:
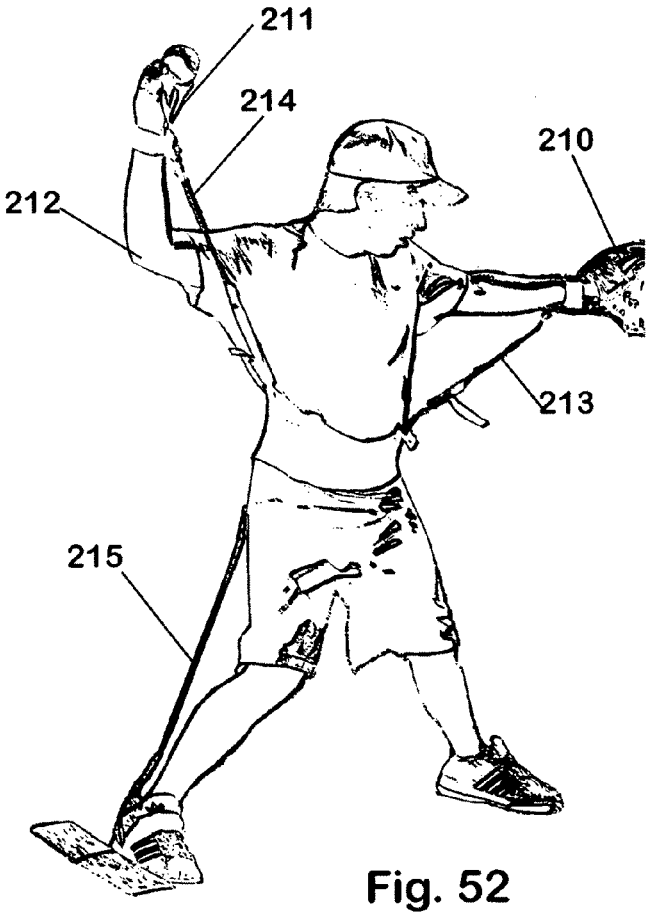

FIG. 52 A side view showing the extension of the wrist straps and the foot strap during the "balance" transition.

FIG. 53 During the "separation" phase, the wrist strap on the "ball" hand is at full tension and the heel of the foot comes up and pivots.

FIG. 54 The wrist and foot straps during rotation.

FIG. 55 The foot strap in the finish position.

Figure 56:
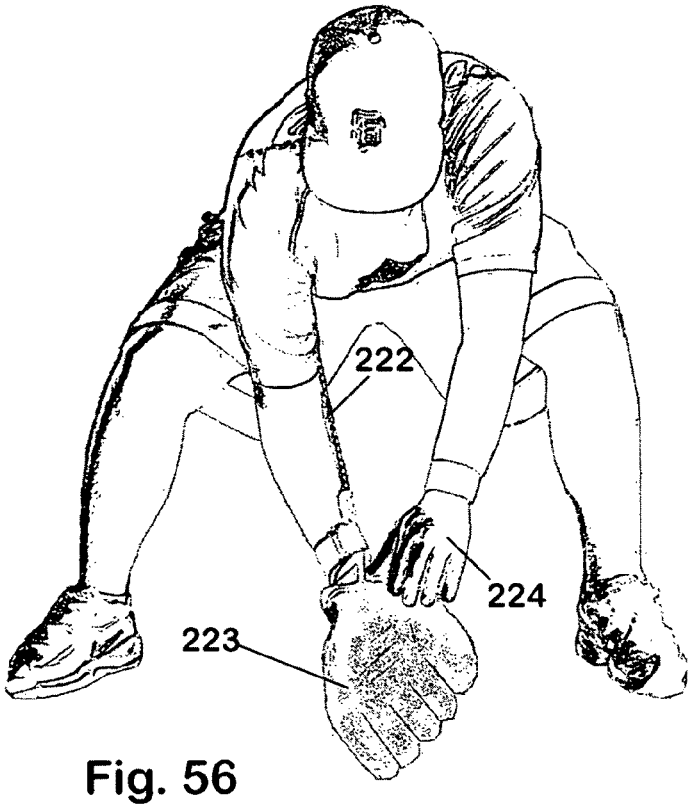

FIG. 56 In fielding, the ready position after the ball has been hit.

Figure 57:
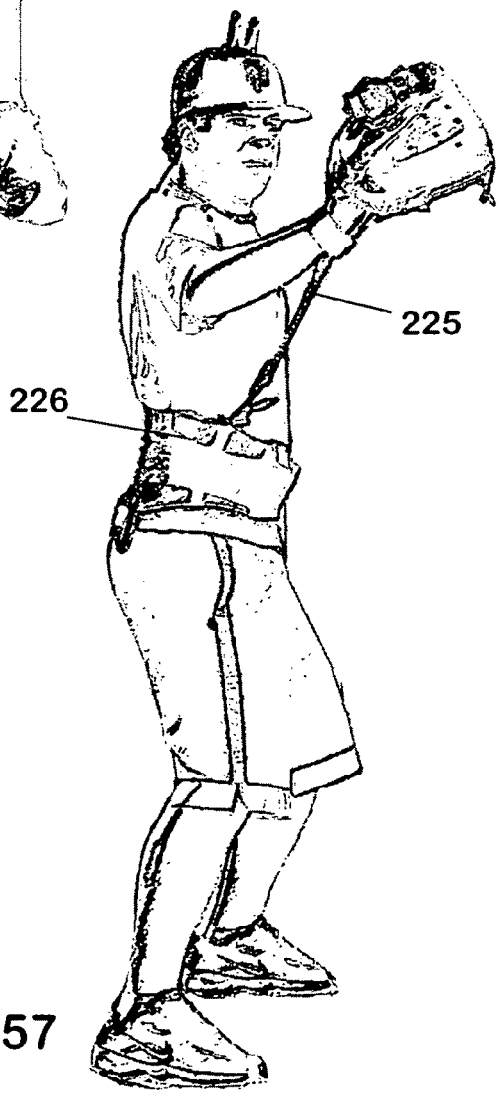

FIG. 57 Preparing to return the ball to the infield.

Figure 58:
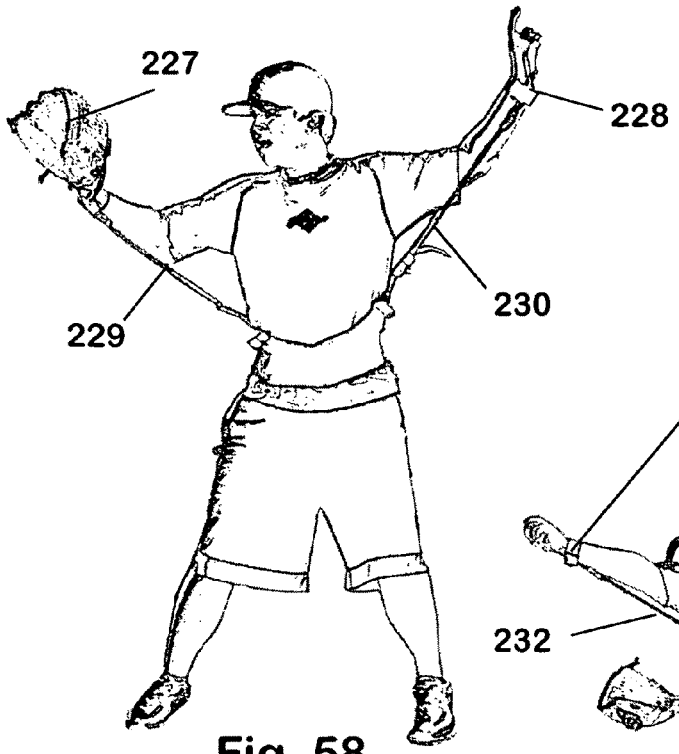

FIG. 58 A side view showing the wrist straps in full tension prior to release of the ball.

Figure 59:
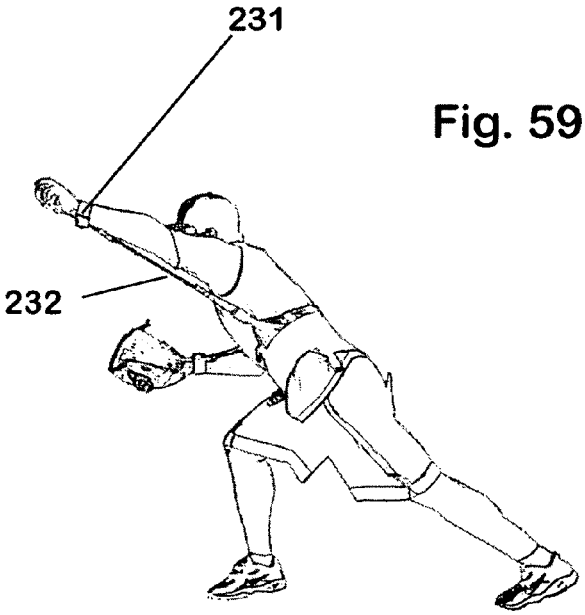

FIG. 59 In fielding, the rotation and release of the ball.

Figure 60:
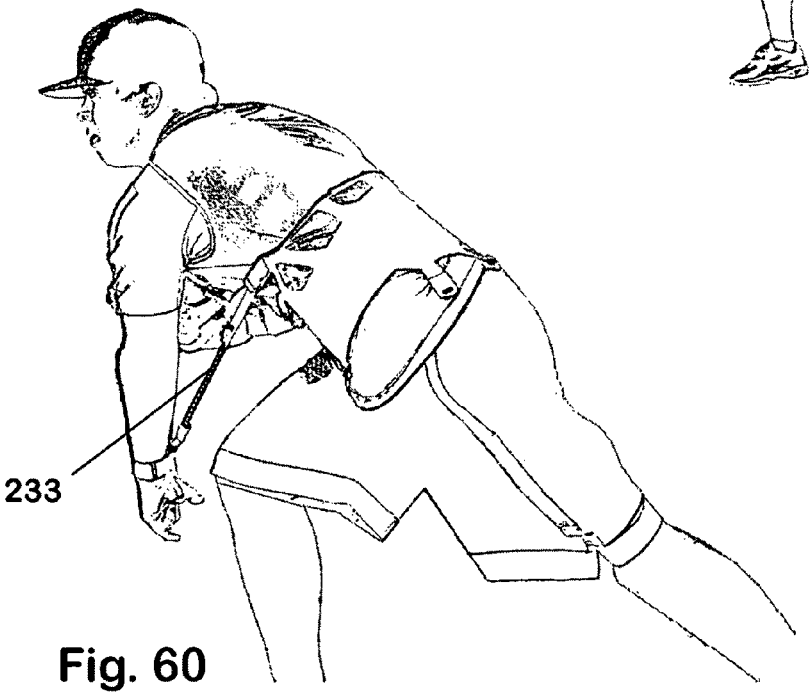

FIG. 60 The fielder's follow through after release of the ball.

FIG. 61 Using the belt to improve the tennis volley. The ready position.

FIG. 62 The contact position as the racket swings through the ball.

Figure 63:
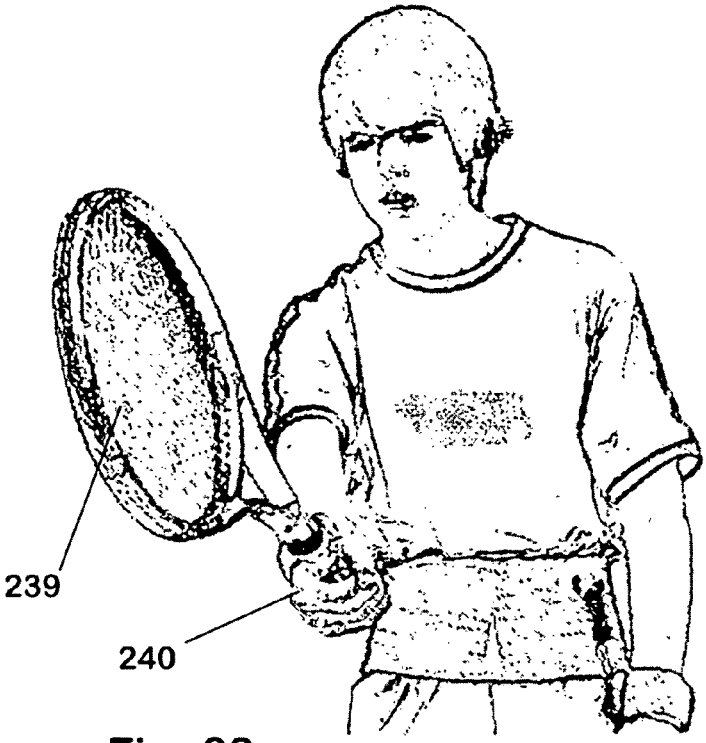

FIG. 63 The follow through with the arm extended and the wrist strap going into tension.

Figure 64:
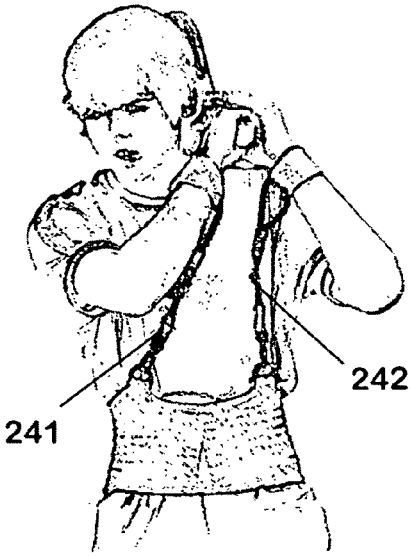

FIG. 64 The finish has the racket over the shoulder and the wrist strap bands fully extended.

Figure 65:
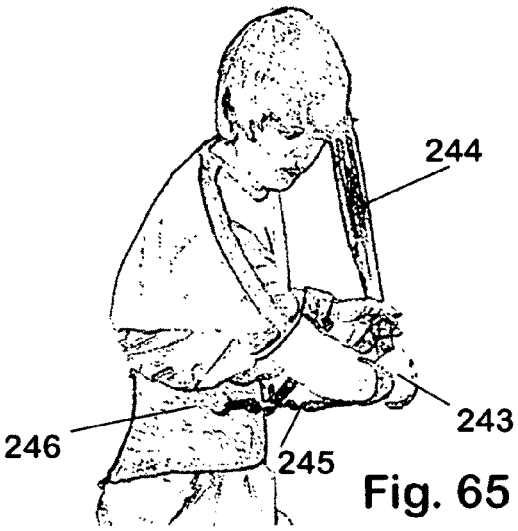

FIG. 65 Using the belt to improve the back hand. Within the setup, the wrist strap is in tension.

Figure 66:
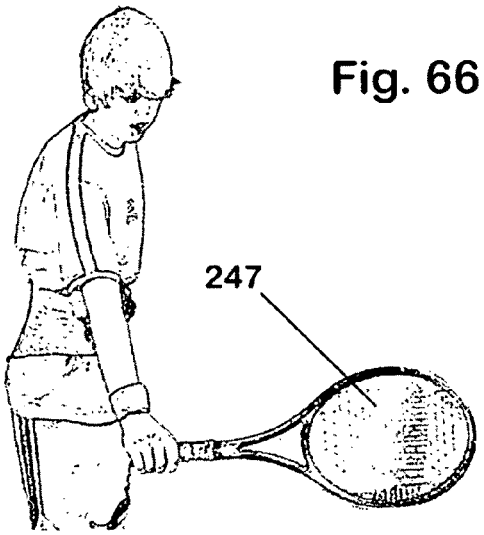

FIG. 66 During contact the arm is extended and the wrist strap applies resistance in order to form a good hand path.

Figure 67:
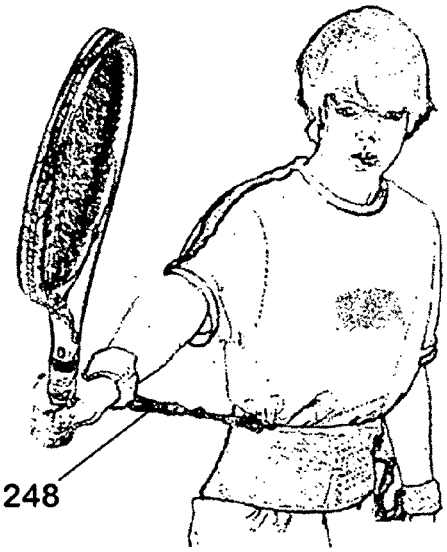

FIG. 67 During the follow through, the wrist strap applies tension as the racket is controlled to the finish.

Figure 68:
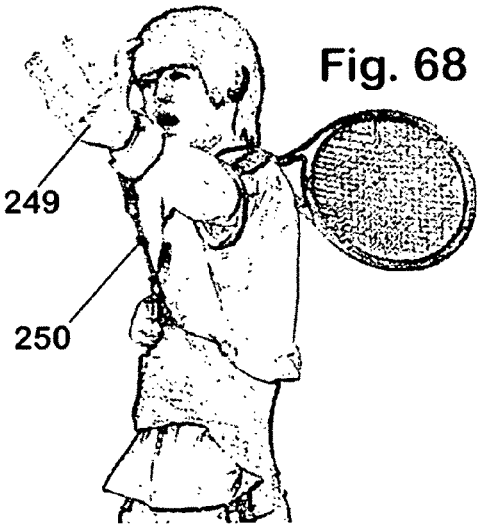

FIG. 68 The serve—The setup; the ball hand and the racket hand wrist straps are at tension.

Figure 69:
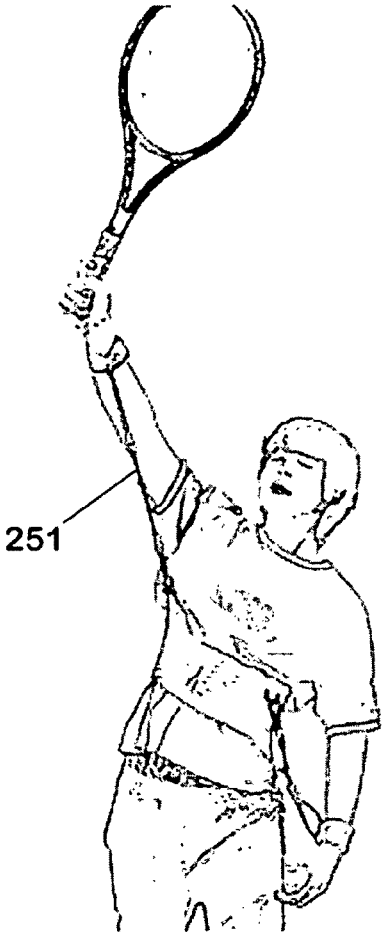

FIG. 69 At full extension, the racket wrist strap is at full tension.

Figure 70:
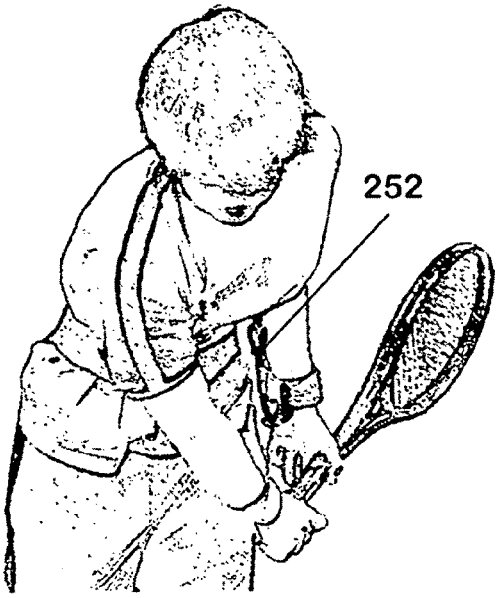

FIG. 70 After hitting the ball, the racket hand follows through to the finish.

FIG. 71 In golfing the setup begins with the club behind the ball, eyes down and the wrist straps relaxed FIG. 72 As the club is brought up and back, into the rotation or pivot of the swing, the wrist straps are in full tension.

FIG. 73 As the club is brought forward, the relaxing of the tension on the wrist straps creates a good hand path through the players extension of the club.

FIG. 74 As the hands come up and over the shoulder, the finish of the swing once again has the wrist straps in full tension.

Figure 75:
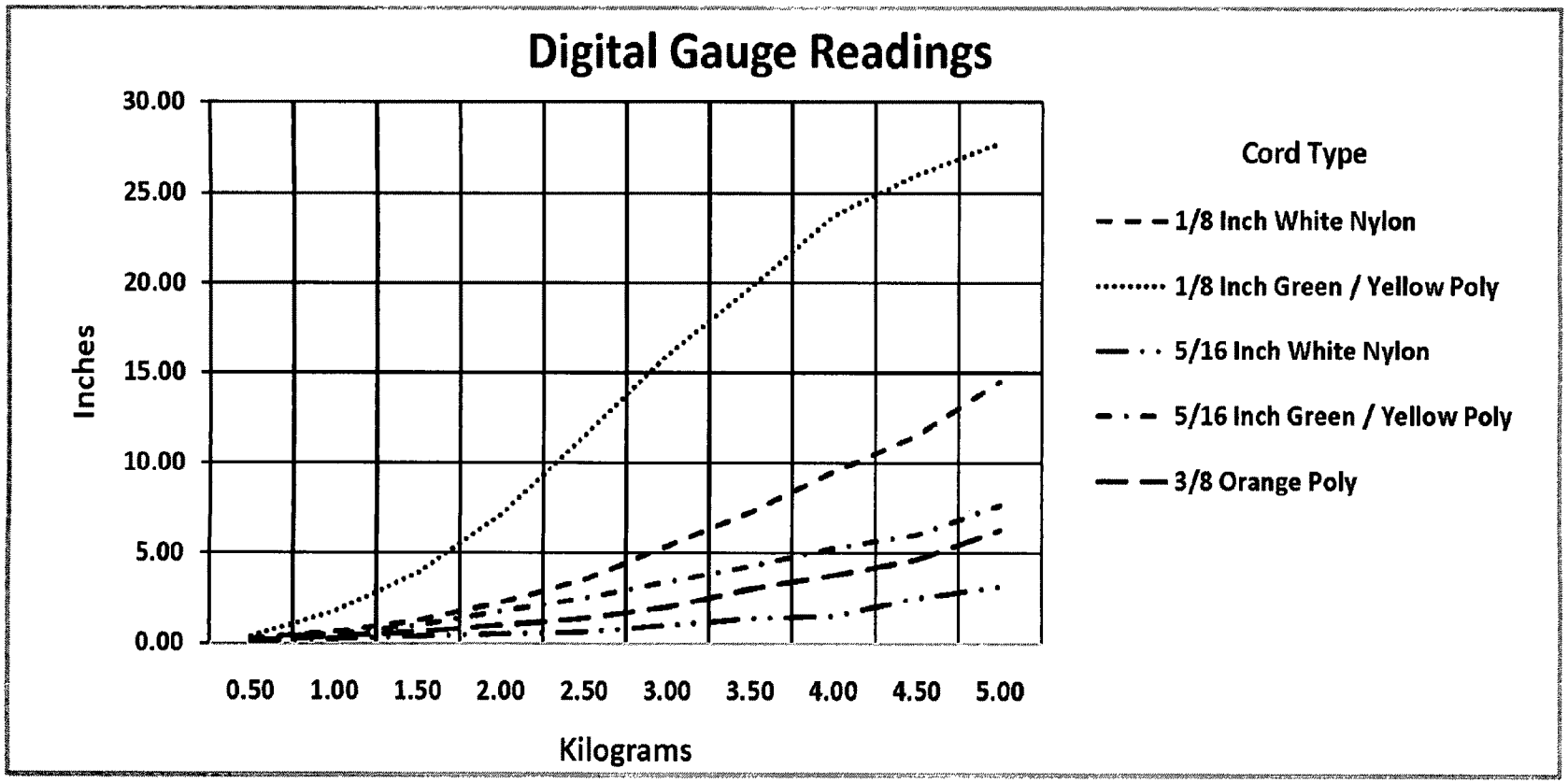

FIG. 75 Is a graph of showing force necessary to stretch various sized elastic cords

DETAILED DESCRIPTION OF THE INVENTION

Assembling the Belt

The primary constituent of this invention is a belt 1 that fits snugly around the waist. The belt is made of several layers of stretch fabric 2 selected specifically for its comfort to the individual as he or she performs the exercises designed to improve the individual's performance.

Figure 1A:
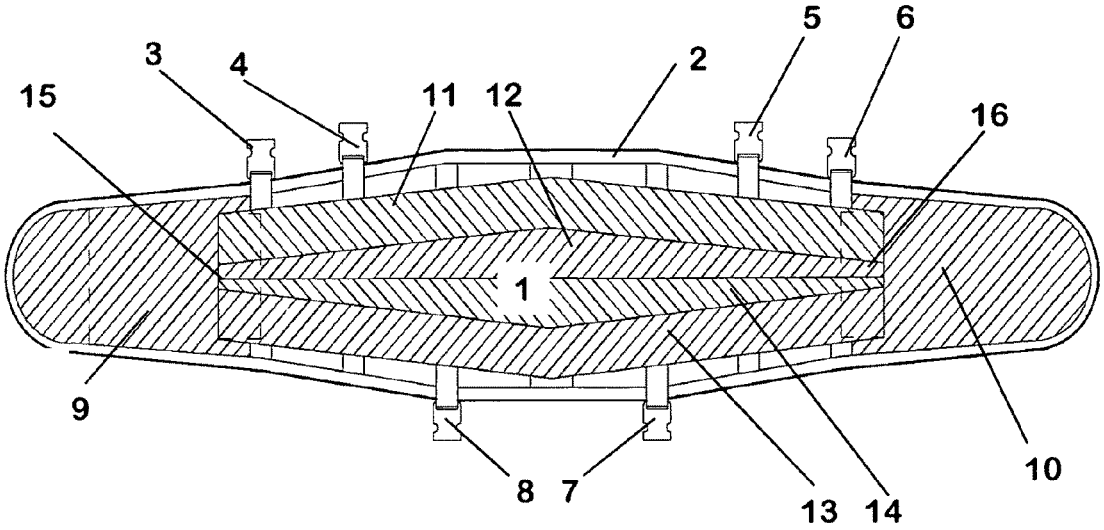

FIG. 1A is an X-ray view of the various layers that make up the sports trainer belt assembly. The diagram represents the middle sized belt. The smaller belt assembly includes only four quick release connectors, two on top and two on the bottom as explained later. In addition, the small belt has smaller quick release buckles so that the larger wrist and foot straps used on the medium and large belts will not attach to the smaller belt. The large belt assembly mimics the medium belt with dimensions that are proportionally larger. This prevents the user from inadvertently attaching the higher tensioned hardware to the small belt, a situation that could cause injury to the user.

As shown in FIG. 1A, there are several buckles 3, 4, 5, 6, 7 and 8 that are attached to the belt using nylon or polypropylene webbing sewn securely to the stretch fabric 2. In addition, there is a section of Velcro or equivalent type loop material 9, 10 sewn to the opposing ends of the belt. Several pieces of stretch material 11, 12, 13, 14 are sewn to the front side of the belt. To the back side of the stretch material is sewn Velcro style hook material 15, 16.

Figure 1B:
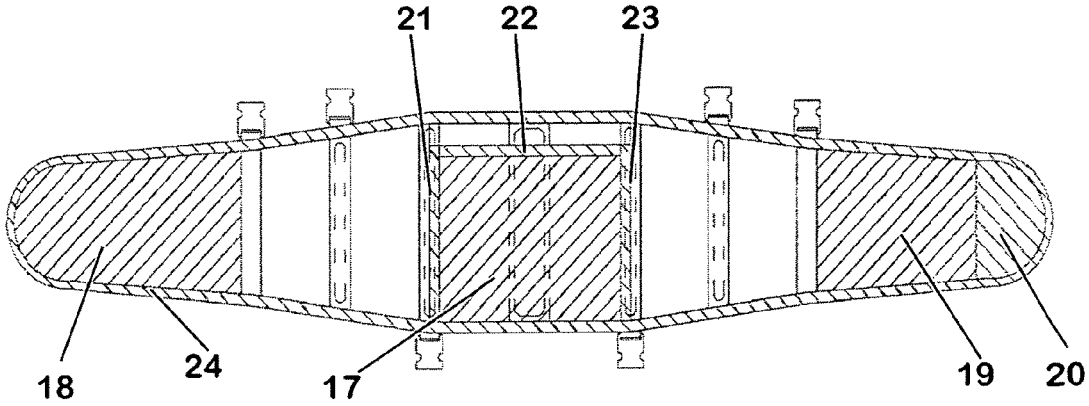

FIG. 1B illustrates the back side of the belt. Included on the back side is a pocket 17; two pieces of a smooth stretch in one direction material 18, 19 and a portion of Velcro style hook material 20. The pocket is finished with three lengths of double folded bias tape 21, 22, 23. The whole assembly has a perimeter of double folded bias tape 24 that provides strength and a finished look to the assembly.

Figure 2:
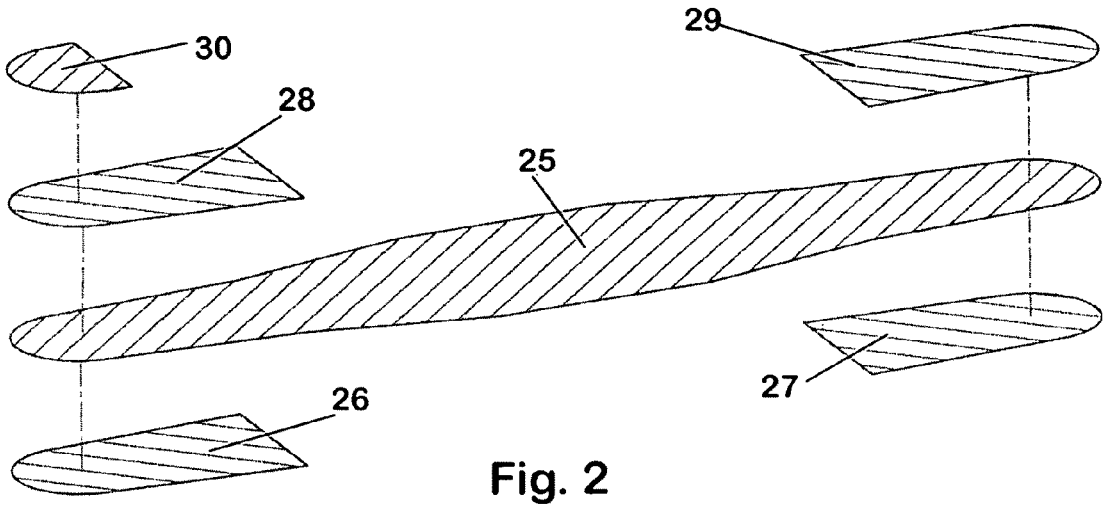

FIG. 2 is an isometric view of the initial assembly of the belt. The manufacturing of the belt begins with a contoured parcel of nylon net material 25. The material is a "stretch in two directions" net material with at least 50% open area. To this, two contoured sections of "Velcro" style Loop material 26, 27 are attached to the bottom side of the Nylon net material. Likewise, two sections of a "Spandex" style "Stretch in one direction" smooth material 28, 29 are attached to the top side of the nylon net material. Finally, a contoured section of "Velcro" style loop material 30 is attached to the top of the one end of the smooth material. All pieces are reinforced with a peripheral stitch and a cross stitch to make the materials lay closely to the nylon net material.

Figure 3:
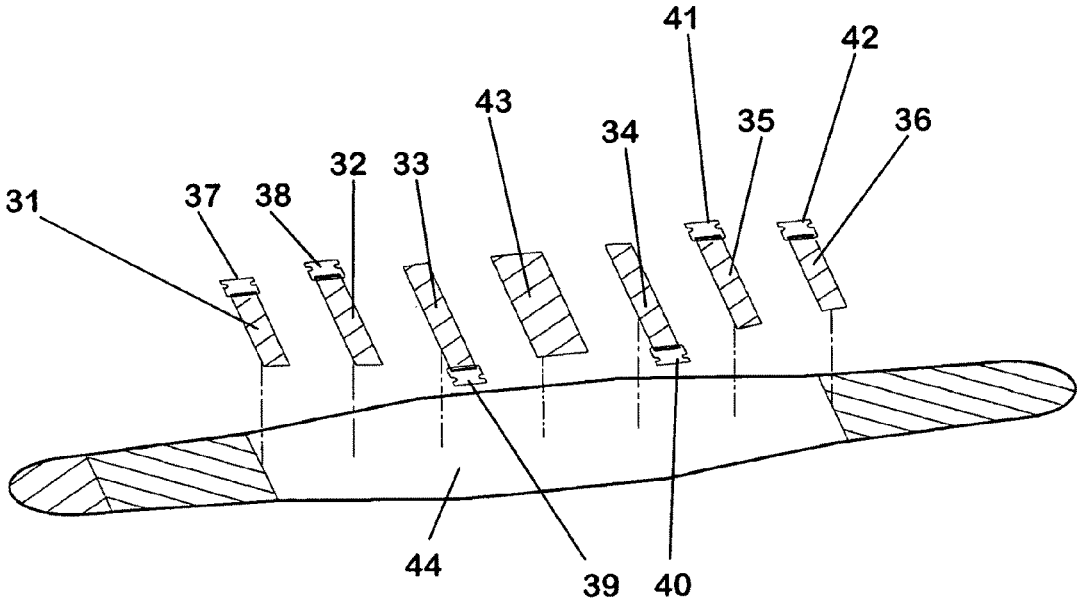

Looking at FIG. 3, six pieces of pre-cut Nylon or polypropylene webbing 31, 32, 33, 34, 35, 36 are prepared with the "female" sections of quick release buckles 37, 38, 39, 40, 41, 42. The webbing is extended one inch through the buckle and cross stitched in order to provide maximum strength to the webbing/buckle interface. An additional piece of wide Nylon or Polypropylene webbing 43 is prepared for addition to the center of the belt. Each of the buckle assemblies are attached to the main belt structure 44 on the "top" side and spaced as per assembly diagrams for the belt assembly. The buckle webbing is double stitched along the periphery of the webbing, and cross stitched to provide strength to the webbing-to-belt body interface.

Figure 4:
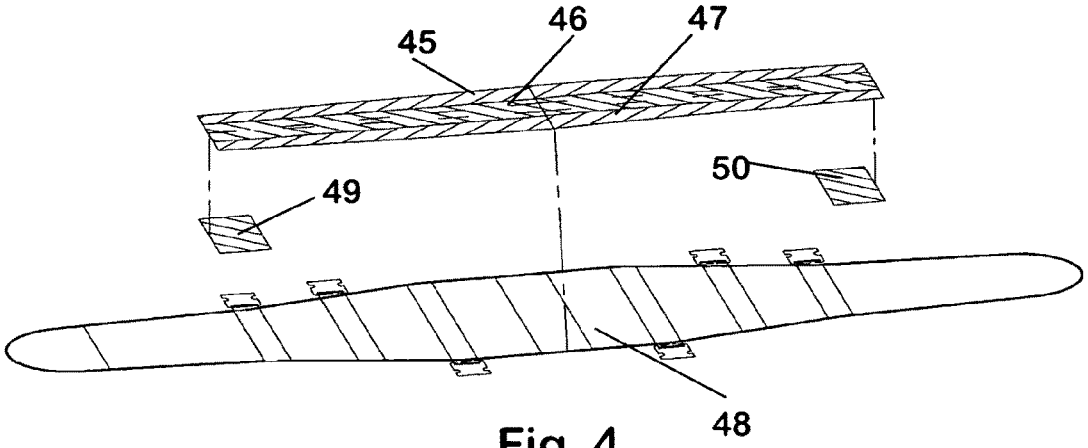
FIG. 4 Illustrates the assembly of the stretch material with its hook closure mechanism being attached to the back side of the belt.

As illustrated in FIG. 4, a set of stretch bands 45, 46, 47 made of an elastic fabric are stitched to the center of the belt 48 assembly with at least two stitches along the centerline of the belt assembly. A cut section of "Velcro" style hook material 49, 50 is attached to the opposing ends of the stretch material. The "Velcro" style material is secured using a peripheral double stitch and a cross stitch in order to provide strength to the "Velcro"/Stretch material interface.

Figure 5:
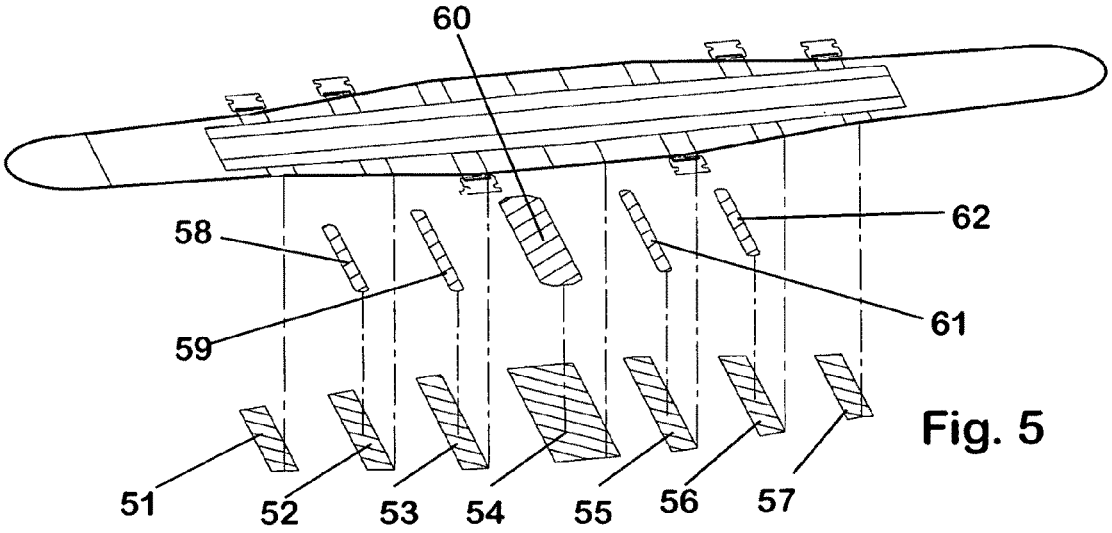
FIG. 5 Shows the placement of the stiffeners and the ribbon like material that seals the stiffeners to the belt.

In FIG. 5, a grosgrain style ribbon 51, 52, 53, 54, 55, 56, 57 or equivalent is attached to the belt assembly 58 on the opposing side to the buckle assemblies. The ribbon is sewn around the periphery on the two long sides and at one end. Nylon or polyethylene stiffeners 58, 59, 60, 61, 62 cut to size as per the belt dimension control drawings are inserted into the open end of the ribbon attached to the belt. Finally, each of the ribbons is sealed, encasing the stiffeners.

In FIG. 6, a pocket 63 made of the net material is attached to the belt assembly 64 on the side of the belt opposing the stretch material. The periphery of the pocket material is stitched with double folded bias tape on three sides 65, 66, 67 in order to strengthen the pocket prior to assembly. The pocket is used as a means for installing an ice bag or heat compress in order to relieve minor lower back pain.

Finally, as depicted in FIG. 6, double folded bias tape 68 is added to the periphery of the belt 64 in order to add strength to the edge of the belt assembly while also smoothing and defining the edge of the belt. The bias material is positioned over both sides of the edge of the belt, and under the extended buckle ends of the buckle webbing. The bias tape is double stitched to the edge of the belt perimeter.

FIG. 7 indicates the dimensions of the belt 69 which are indicated as being relative to a specific dimension (X). The relative dimensions define and illustrate the symmetry of the belt assembly.

Assembling the Wrist Strap

As shown in FIG. 8, an appropriate length of a grosgrain ribbon material 70 or equivalent is fashioned as below with the four corners 71, 72, 73, 74 being removed as shown. The edges of the ribbon 70 are folded as shown in FIG. 9 75.

As depicted in FIG. 10, a portion of Velcro style loop material 76, the ribbon cut and folded above 77, and a short piece of "Velcro" style hook material 78 are sewn together using double stitching around the parameter of the assembly. Additional stitching is added across the interior end of the hook material.

In FIG. 11, the assembly 79 with the hook material 80 placed as shown has a rectangular ring 81 attached by inserting the strap 79 into the ring and folding over about one inch 82. A "D" ring 83 is centered in a length of nylon or polypropylene webbing 84 that is sized to allow the "D" ring to protrude just past the edge of the strap 79 while extending past the edge of the strap 79 the width of the strap 79. In addition, a length of ribbon 85 is fashioned whereby a loop 86 that is approximately three inches long plus an extension of the two ends that protrudes just past the opposing edge of the strap 79. The folded end of strap 79, the piece of webbing with the D-ring 84 and the loop material 86 are sewn together with a double peripheral stitch and a cross stitch to add strength to the interface.

As shown in FIG. 12, a length of Stretch "Bungee" cord 87 is attached to the "D" ring 83 which is a part of assembly 88 completed in the previous step. The Stretch cord 87 is attached by being folded over the "D" ring and secured using three clamping rings 89, 90, 91. The rings used may be "Hog Rings" or an equivalent. The "hog rings" are attached using an acceptable tool that sufficiently clamps the rings so that the stretch cord is held in place even when stretched to its maximum tension, providing the proper resistance as the belt assembly is used in the application. In order to finish up the assembly of the "strap" end of the wrist strap, a piece of heat shrink tubing 92 is placed over the rings and bungee cord, securing the stretch material attached to the wrist strap assembly 83 with the tubing sized to sufficiently cover the rings in order to keep the rings from snagging clothing or eliminating the possibility of the ends of the rings scratching the participant. The heat shrink tubing is heated sufficiently to close the tubing snuggly over the closed end of the bungee cord assembly. The finished assembly is depicted in FIG. 14.

In FIG. 13, a piece of appropriately dimensioned webbing 93 is attached to the opposing end of the bungee cord 94, folding the bungee cord over as described above, wrapping the webbing around the folded end of the cord, and securing the cord and webbing with three clamping rings 95, 96, 97 as described in the FIG. 12 description. Again, heat shrink tubing 98 is placed over the cord/webbing interface and heated in order to shrink the tubing snuggly.

Finally, as shown in FIG. 14 which is a depiction of the final wrist strap assembly 99 the length of the stretch material 100 is sized so that adjustment of the strap 101 will provide proper resistance over a range for the total length of the wrist strap assembly. The male end of a quick release buckle 102 as detailed in FIG. 15 is attached to the Nylon or polypropylene webbing 103, routed through the connector as indicated so that the webbing will not slip out of the buckle during use.

FIGS. 16 and 17 illustrate proper closure of the wrist attachment loop 104 over the wrist 105. The wrist attachment loop is encircled around the wrist with the loop material 106 side up and fed through the rectangular ring 107 positioned at the opposing end of the wrist attachment loop. The 3 inch loop 108 is placed over the thumb 109 at which time the hook material 110 is secured to the loop material 111 on the outside of the wrist attachment loop. The bungee cord 112 with its connector is placed in one of the quick release connectors in the belt not illustrated as per instructions in the "how to use" section further on in this document.

Assembling the Foot Strap

The assembly of the foot strap begins as shown in FIG. 18 with a length of approximately one and a half inch wide Nylon or Polypropylene webbing 113.

Looking at FIG. 18, to the webbing, approximately three inches of one and a half inch wide "Velcro" style loop material 114; "Velcro" style hook material 115 are attached to the "base material 113. A metal rectangular ring 116 is attached to the opposing end of the base material 113 from the loop material 114 by placing the base material through the rectangular ring 116 and folding over the base material about one inch. A length of one inch wide Velcro style hook material 117 is sewn on to the base material 113 approximately half way between the sewn portion of the rectangular ring 116 and the hook material 115. This hook material is sewn to both sides of the base material 113 using double peripheral stitching.

As illustrated in FIG. 19, a length of one and a half inch webbing 118 is placed on top of the folded over base material 119, the folded base material and the added length of webbing 118 are sewn together. The assembly at this point is sewn with a double peripheral stitch and a cross stitch in order to provide sufficient strength to the interface.

Measuring three inches from the end of the webbing 120 of the assembly 121 shown in FIG. 20, a length of one and a half inch webbing 122 with a D-ring 123 inserted over the end of the material leaving a one and a half inch overlap to be sewn to the webbing 120. A length of Velcro style loop material 124 is sewn to the opposing end of the webbing 122. The length of webbing 122 is folded over the webbing 120 as indicated above and sewn with a double cross stitch in order to provide maximum strength to the interface.

The length of webbing 120 is folded at two right angles as illustrated in FIG. 21 and is folded over 125 and using double stitching around the periphery of the interface and cross stitching in order to add sufficient strength to the webbing to base interface.

As seen in FIG. 22, a length of Stretch "Bungee" cord 126 is attached using the same procedure described in the manufacture of the wrist strap described above. Hog rings 127, 128, 129, 130, 131, 132 are attached to the folded bungee cord 126 with the D-ring 133 within the bungee cord loop 134 prior to fastening the hog rings 127, 128, 129. The heat shrink tubing 135 is applied over the hog rings and shrunk tightly around the hog ring—bungee cord assembly. Likewise, the other end of the bungee cord is folded over, the webbing 136 applied to the interface, and hog rings 130, 131, 132 tightened over the assembly. A length of heat shrink tubing 137 is applied to the webbing/bungee cord/hog ring interface and shrunk tightly over the sub assembly. The connector 138 is attached to the webbing as illustrated in FIG. 15.

FIG. 23 illustrates the foot strap final assembly 139.

Using the reference numbers from FIGS. 18 to 23, FIG. 24 illustrates how the foot strap is installed on the player's shoe. The "D-Ring" 133 is installed on the back of the shoe with the strap 134 going down and under the shoe. On the bottom of the shoe, the hook material 124 connects to, and is folded over to connect to the one inch loop material 117 sewn onto the base webbing 113. The strap with the Rectangular ring 116 wraps over the top of the shoe. The end of the strap with the hook material 114 then passes through the end of the rectangular ring and up in the air, ready to fold over and attach to the loop material 115.

FIG. 25 shows a side view of the shoe with the foot strap secured around and over the top of the shoe.

How to Use the Trainer with its Accessories

The following is an explanation as to how to properly use the Universal Power Sports Trainer here-to-for identified as "The Trainer". The trainer is a light weight belt that is fitted snugly around the waist. The trainer incorporates wrist and foot strap accessories that when attached properly will provide a workout that will dramatically improve the hand path and control of the ball when hitting, pitching, and fielding a baseball; driving a golf ball; or serving and volleying a tennis ball. While other sports will benefit from proper use of the trainer, only these sports will be detailed herein.

Proper Closure of the Trainer

As shown in FIG. 26, when closing the trainer (140), it is important that the user make the trainer fit snugly, however, the trainer should not be so tight that it does not move up or down at all. One rule of thumb would be that after closure, you should be able to place two fingers between the trainer and body and move the fingers up and down without causing the trainer to bunch up. As shown, the maximum trainer size is created by having the trainer hook closure material, shown as a phantom line 141 overlap the loop material 142 by at least the width of the hook material as indicated by the line 141.

Likewise, the minimum trainer size is created by overlapping the hook material 143 and loop material 144 as shown in FIG. 29. The hook material depicted by the phantom line may be extended right up to the edge of the buckle webbing 145. The maximum and minimum size for each type of the belt is outlined in Table 1.

TABLE 1

| Size | Overall Length | Minimum Closed Length | Maximum Closed Length |
|---|---|---|---|
| Small | 32 inches | 22 inches | 30 inches |
| Medium | 42 inches | 32 inches | 38 inches |
| Large | 52 inches | 40 inches | 48 inches |

Closure of the Stretch Material

After adjusting the trainer closure properly, the stretch material should be closed over the hook and loop closure. In FIG. 28, the trainer 146 is closed at its maximum diameter. The ends of the stretch material 147, 148 are closed over the overlapping closure made in the previous step. Each end of the stretch material is attached to a section of hook material (not shown) that makes a strong bond to the areas of loop material on the front of the belt. Each section of stretch material is pulled equidistant from the attachment in the rear of the trainer and secured to the loop material as equally as possible.

When the trainer is closed to a minimum diameter as illustrated in FIG. 29, again, each section of stretch material 149, 150 is pulled equidistant from the attachment in the rear of the trainer and secured to the loop material as centered on the trainer.

Proper Attachment of, and Use of, the Wrist Straps and Foot Strap for Baseball, Golf, and Tennis In FIG. 30, the trainer 151 diagram indicates the optimal configuration for a left-handed hitter, golfer practicing his drive, and tennis player practicing his forehand and backhand return of the ball. The wrist straps 152, 153 are connected to the two top quick release buckle connections closest to the trainer closure as indicated. The foot-strap 154 is connected to the bottom quick release connector as indicated. For a left-handed hitter, the foot strap is connected to the quick release buckle on his left hand side. In the following diagrams, the quick release buckles attached to the trainer are from the user's perspective.

In FIG. 31, the trainer 155 diagram indicates the optimal configuration for a right-handed hitter, golfer or tennis player. The wrist straps 156, 157 are connected to the two top quick release buckle connections closest to the trainer closure as indicated. The foot-strap 158 is connected to the bottom quick release connector as indicated. For a right-handed hitter, the foot strap is connected to the quick release buckle on his right hand side.

In FIGS. 32 and 33, the right and left configurations for pitching exercises are described for baseball, or serving for a tennis player. In order to configure the trainer for a left-handed pitcher, two wrist straps are inserted into the two outer top quick release connectors 159, 160 and one foot strap 161 is connected to the player's left hand lower quick release connector.

In order to configure the trainer for a right-handed pitcher or tennis player, as indicated in FIG. 33, two wrist straps are inserted into the two outer top quick release connectors 162, 163 and one foot strap 164 is connected to the player's right hand lower quick release connector as shown in FIG. 35.

In FIGS. 34 and 35, the right and left configurations for fielding exercises in baseball are described. In order to configure the trainer 165 for a left-handed fielder, two wrist straps are inserted into the left hand outer top quick release connector 166 and the inner right handed top quick release connector 167. One foot strap 168 is connected to the player's left hand lower quick release connector.

In order to configure the trainer for a right-handed fielder, two wrist straps are inserted into the left hand inner top quick release connector 169 and the outer right handed top quick release connector 170 as indicated in FIG. 35. One foot strap 171 is connected to the player's right hand lower quick release connector.

Each Wrist strap is connected to a length of "Bungee" style stretch material. In addition, there is a length of webbing attached to the opposing end of the stretch material from the wrist strap. The following table catalogs the various parameters for the wrist strap assemblies. There are two sizes for the wrist straps each optimized for use by the skill and size of the persons using the trainers. For safety, the quick release buckles used on the small trainer are smaller than those used on the medium and large sized trainers. This prevents an inadvertent attachment of the small trainer wrist straps to the larger trainers, a situation that could cause injury through over-stressing the small trainer "beginner" trainer configurations.

Adjusting the Tension of the Wrist Strap and Leg Strap

The Table II is used to properly size the cord used on the wrist strap to the ability of the player using the trainer. In the following section, the importance and use of this Table will be further explained.

The Table III is used to properly size the cord used on the leg strap to the ability of the player using the trainer. In the following section, the importance and use of this Table will be further explained.

TABLE II

| | Wrist Strap Style | Bungee Cord Length (D-Ring to D-ring | Bungee Cord Thickness (diameter) | Adjustment Length (D-Ring to quick release connector) |
|---|---|---|---|---|
| Small | Small | 7 inches | 1/8 inch | 8 to 17 inches |
| | Medium | 9 inches | 1/8 inch | 9 to 19 inches |
| Medium | Medium | 7 inches | 3/16 inch | 8 to 17 inches |
| | Large | 9 inches | 3/16 inch | 9 to 19 inches |
| Large | Medium | 8 inches | 5/16 inch | 9 to 20 inches |
| | Large | 10 inches | 5/16 inch | 11 to 22 inches |

TABLE III

| Size | Foot Strap Style | Bungee Cord Length (D-ring to D-ring) | Bungee Cord Thickness (diameter) | Adjustment (D-Ring to quick Release Connector) |
|---|---|---|---|---|
| Small | Small | 10 Inches | 1/8 Inch | 11 to 18 inches |
| | Medium | 12 Inches | 1/8 Inch | 13 to 20 inches |
| Medium | Medium | 15 Inches | 3/16 Inch | 16 to 23 inches |
| | Large | 20 Inches | 3/16 Inch | 21 to 27 inches |
| Large | Medium | 25 Inches | 5/16 Inch | 26 to 32 inches |
| | Large | 30 Inches | 5/16 Inch | 31 to 38 inches |

The graph shown in FIG. 75 provides information about how much force it takes to stretch various sizes of the Bungee Cords used as the elastic members in the wrist straps and foot straps. Any reference to an elastic member having a diameter cited in the table above should be understood to require the same force to stretch as a band of the same diameter shown in the graph.

Hitting

The player attaches the wrist straps to each respective arm as described above. Holding the bat as illustrated in FIG. 37 the tension on the wrist strap should be adjusted until the player is able to hold his bat in the rotation position without stressing his muscles such that it causes twitching when held in the this position for 30 seconds. If the player's muscles do start to twitch, lengthen the wrist strap by adjusting the webbing through the quick release connector by one to two inches. The objective is to provide a maximum amount of tension while not over-stressing the muscles. Only a maximum of 20 reps per day are required in order to provide the proper muscle memory in order to develop an optimum hand slot for effective long ball hitting.

FIGS. 36 through 40 demonstrate how the belt works to improve a players swing and contact with the ball when playing baseball or softball. The belt is designed to provide training of the players muscles and to develop "memory" for optimal control over the bat throughout the various components of the swing. Because the belt references the swing action to the players waist, symmetry necessary to create a proper swing, with changes in tension on the belts extensions to the arms, and at the proper times in order to create the proper muscle memory within the player, allows the player to create a dramatically improved control of and relationship with the bat.

When dissecting the important components of the swing, one can identify five distinct actions and reactions that make up the various swing components. The swing begins with the "hand slot" (FIG. 36) whereby the player lines his body up with the pitcher and cocks the bat 172 up over his leeward shoulder 173. In this position, the elastic straps 174, 175 are tensioned to a maximum resistive force. As the bands are attached to the inner side release buckles, 176 on the belt 177 and are adjustable in length to optimize the tension created to the needs of the individual player. The player's hands are positioned in an optimal position for the initiation of a proper swing. As the pitcher releases the ball, the player begins his/her "rotation or pivot" (FIG. 37) phase of the swing. During this phase the arms begin to come forward and down. The bands 178, 179 begin to lose tension; however, initially they keep the hands in proper alignment to develop maximum power as the swing begins. At the "contact" position (FIG. 38), the belts 180, 181 have released all tension allowing the player to use his hand/eye coordination to align the bat with the ball, and provide maximum power at contact to the balls flight.

As shown in FIG. 39, a proper "extension" of the bat 182 after contact, begins with a re-tensioning of the straps 183, 184 in order to help develop a proper follow through of the bat after contact. Finally, in FIG. 340, the straps 185, 186 return to maximum tension during the "follow through" helping the body to stay tall. This assistance in keeping the body upright and tall provides the culmination of a proper swing and maximum power being placed onto the ball. Ten to fifteen reps per day using the belt during batting practice helps the players coordination and development of muscle memory related to a proper power swing.

FIG. 41, the "hand Slot" indicates how the foot strap 187 can be used in conjunction with the wrist straps 188, 189 in order to help with the positioning of the leading foot during the initiation of the swing of the bat. By adding the foot strap and its elastic tether 190, feedback as to the position of the foot during the various components of the swing is provided to the player through connection of the foot strap to either of the bottom buckles 191 on the belt 192.

Looking at FIG. 42, as the player continues through the mechanics of the swing and into the "pivot", the tether 193 pulls on the heel of the foot in order to remind the player to bend the knee, thus providing more power to the bat. At this point, the tension in the foot strap is released, as long as the player has attained the proper position.

As shown in FIG. 43, the player continues through the swing and into the "contact" position, the foot strap 194 remains loose as long as the foot is raised and in the right position with the knee bent.

During the "Extension" depicted in FIG. 44, the foot begins to flatten out and the foot strap 195 begins to tighten up. As the swing continues to the "finish" position as seen in FIG. 45, the body rotates thus tightening the foot strap 196.

Pitching

The trainer provides the pitcher with a workout that helps develop muscle memory and a good hand path for the pitcher. As seen in FIG. 46, the wrist straps 197, 198 are relaxed as the pitcher is in the "setup" position. For pitching exercises, typically, the wrist straps are attached to the outer front quick release connectors 199, 200.

As the player transitions to the "balance" position, the wrist straps 201 are inside of the arms and are beginning to tighten as shown in FIG. 47.

During the wind up or "separation" phase, the wrist strap on the "ball" hand moves to full tension. The wrist strap on the glove hand 202 remains relaxed as shown in FIG. 48. During this phase, the glove hand leads the throwing arm to max resistance.

In FIG. 49, the transition from the separation phase into the "rotation" phase has the throwing arm 203 moving forward in a pivot motion with the wrist strap 204 continuing in constant and maximum tension. This continues through the release of the ball with the glove hand wrist strap 205 in a relaxed configuration, and the throwing hand wrist strap 206 continuing in full tension. This constant tension on the throwing hand wrist strap helps the player to develop a consistent hand path as he/she brings the ball through and to the release and finally the finish.

FIGS. 51 to 55 provide a side perspective of the five basic positions of the pitch incorporating a different perspective as to the mechanics of the wrist strap and incorporating the foot strap into each position. During the setup as shown in FIG. 51, the pitcher has his foot 207 on the ball hand side placed firmly against the rubber 208. The wrist straps 209 are relaxed with the hands in close to the pitchers body.

In FIG. 52, the pitcher rotates toward the plate, extending his glove hand 210 to the batter, and bringing the ball hand 211 up and back, keeping his elbow 212 perpendicular to the ground, with the wrist straps 213, 214 in tension. The foot strap 215 also goes into tension as the pitcher rotates his body. The straps help to develop muscle tone through resistance as well as keep the hands from extending too far as the tension increases. This helps the player to develop consistency in his wind up and pitch of the ball.

As depicted in FIG. 53, the players ball side 216 foot comes up and off of the rubber 217, and rotates forward as the player begins the separation phase. Here, the ball hand strap 218 is at tension, helping to control the arc as the ball moves forward and into the "rotation".

Looking at FIG. 54, during rotation, the pitchers body extends forward bringing tension to the foot strap 219 and the wrist strap on the ball hand 220 as the pitcher releases the ball.

After releasing the ball, the pitcher follows through to the finish position the foot strap 221 tight, keeping his leg on the ball hand side in line with the plate.

Fielding

In fielding the ball in both baseball and softball, there are five basic positions that the player transitions through as he/she first reacts to a hit ball, retrieving the ball, and returning the ball to the infield, whether it be to a base for an out, or to stop the run by getting the ball into play whereby the advancing player must remain on base. The trainer helps the fielder develop consistency in his fielding of the ball, and develop muscle tone and muscle memory.

After a ball is hit, the fielder typically assumes the "setup" position as depicted in FIG. 56. In this position, the hands are extended down with the wrist straps 222 at full tension. The glove 223 is low to the ground, and is facing home plate, ready to capture the ball as it moves toward the fielder. The non-glove hand 224 is positioned up and in front of the glove ready to capture the ball as it enters the fielder's glove. The strap on the non-glove hand is also at tension causing the player to extend the hand down and out.

Shown in FIG. 57, the glove hand wrist strap 225 is connected to the outermost quick connect connector 226 on the belt. In this position, the fielder is "setup" for the fielding of a fly ball.

In FIG. 58, the player is in the "pivot position; with the arms positioned for the returning the ball back into the infield. In this position, the player moves the glove hand 227 in line with the zone whereby the player wants to deliver the ball, his throwing hand 228 back and fully extended in order to get maximum power behind the ball as he releases it. In this position, the wrist straps 229, 230 are at maximum tension.

As the player moves his throwing arm 231 forward, the wrist strap on the "ball" hand 232 helps the player develop an arc that maximizes the force delivered to the ball. Resistance plays a part in assisting the player with the development of a good hand path as well as increased strength in the throwing hand.

In the "finish" position as shown in FIG. 60, the throwing hand completes its arc after the release of the ball. In this position, the throwing hand wrist strap 233 continues to be in tension completing the hand path. This follow through improves the accuracy of the throw.

Tennis

Because tennis involves the development of consistency in the swing, a good hand path to the ball; and increased strength in the muscles that affect the swing, the trainer is capable of dramatically improving ones tennis game as it does in baseball. Our experience has been that a disciplined regiment with the trainer and only a few reps per day will dramatically improve one's game. Our experience with the trainer used for the development of tennis performance improves one's forehand swing, backhand swing and serve.

Forehand

With tennis, there are four basic positions associated with the development of one's forehand. In FIG. 61, the player begins with the "setup". In this case, the racket hand is up and behind the player. In this position, the racket hand wrist strap 234 is at tension. Resistance should be set so that the player can hold this position for at least 30 seconds without causing muscle spasms or twitching. If muscle spasms occur, the player should lengthen the wrist strap an inch to an inch-and-a half in order to reduce the tension on the trainer. Over tensioning the trainer will actually reduce the benefits of a workout with the trainer. The wrist straps are attached to the front quick release connectors 235 on the trainer.

As the player moves the racket hand 236 to the "pivot" position, the wrist straps 237, 238 are at a relaxed position. As the player continues the swing, the racket comes up and forward after contact with the ball. The trainer controls the hand path as it creates muscle memory and consistency in the swing.

FIG. 63 indicates the position of the racket 239 as it moves through to the "contact" whereby contact is made with the ball. With a firm grip 240 on the racket, the trainer has created a good hand path with the racket perpendicular to the path of the balls return. In this case, the trainer tension is increasing as the player transitions to the finish.

In FIG. 64, the racket is brought to the finish position with both hands. The wrist straps 241, 242 gain tension as the racket is brought to the final position.

Backhand

As shown in FIGS. 65 to 67, the wrist straps are in tension all the way through the back swing. This creates an arc with the racket that helps develop a good hand path and muscle memory that results in a very effective and consistent swing.

In FIG. 65, the lead hand 243 is firmly gripping the racket 244 with the racket held perpendicular to the ground. The wrist strap tensioning cord 245 on the lead hand is at tension with the quick release buckle 246 forming a pivot point for the backhand swing.

The racket moves forward, as is shown in FIG. 66. The racket 247 remains perpendicular to the ground. The trainer helps to maintain control of the racket and to develop consistency in the swing.

At the "finish", the wrist strap tensioning cord 248 remains at full strength, developing a consistent follow through for the racket.

Serve

Training for the tennis serve begins with a "setup" position as we have seen in the other training procedures discussed above. In FIG. 68 the serve begins with the racket hand up and away. The wrist strap on the racket hand is at full tension. The ball hand 249 is up and out in front of the player with the wrist strap 250 in full tension. The wrist strap for the ball hand and the racket hand are placed in the innermost quick release connectors in the front of the belt.

As shown in FIG. 69, the ball is served, the racket is extended and the trainer tension on the racket hand wrist strap 251 is at maximum. With eyes on the ball, the racket hand moves in an arc, keeping the tension constant on the trainer.

The finish in FIG. 70 shows tension relaxed on the trainer wrist straps 252. The trainer helps in the development of a good hand path and helps develop muscle memory so that when the player works out with the trainer removed, he has developed consistency in his swing.

Golf

Using the trainer for the development of a golf swing is very similar to the techniques described in the hitting section above. Throughout the years, training devices designed for baseball or golf have proven to be interchangeable.

In setting up the trainer for golf, as shown in FIG. 71, the wrist straps 253 are connected in front to the innermost quick release connectors 254 on the front of the belt. While there are wrist straps on both hands, for this illustration the wrist strap and its respective connector on the left hand side are the only ones visible in this illustration. At the setup, the wrist strap tension is relaxed 255.

As the golfer brings his club 256 back to the pivot position as shown in FIG. 72, the wrist straps are at full tension.

The golfer swings the club through the contact position with the trainer straps 257, 258 at full tension as illustrated in FIG. 73.

As the golfer completes his swing, shown in FIG. 74, the straps 259, 260 remain at full tension. The tensions on the straps maintain control over the arc of the swing and provide a good hand path throughout the swing. The result is that the use of the belt develops a good hand path for the swing reducing the tendency to slice or pull the ball while also increasing muscle tone for a longer drive of the ball.

To those skilled in the art it will be understood that there can be many other variations of the embodiments that have been described above while still achieving the same objectives of the invention. Such variations are intended to be covered by the scope of this invention. As such, the foregoing description of embodiments of the invention is not intended to be limiting. Accordingly, it is intended that the appended claims will cover all modifications of the invention that fall within the true spirit and scope of the invention.

What is claimed is:

1. A sports training belt comprising:

a first band of fabric configured to wrap around the waist of a user; said first band having a first end, a second end, an inside surface, an outside surface, an upper edge and a lower edge; said band having an essentially rectangular shape;

a first paired fastener comprising a first and a second fastener elements; wherein said first fastener element is attached to said first end of said band and wherein said second fastener element is attached to said second of said band so that said first end of said first band and said second end said first band can be detachably secured to each other;

a first element of a first wrist strap fastener pair and a first element of a second wrist strap fastener pair attached to the upper edge of said first band; said elements of said first and said second wrist strap fastener pairs spaced about equidistant from the middle of said first band;

a first element A and a first element B of a foot strap fastener pair attached to the lower edge of said first band; said first elements A and B spaced about equidistant from the middle of said first band;

a pair of wrist straps each being length-adjustable and each further comprising a non-removable, fixed length elastic member; each of said wrist straps having a first end and a second end, said first end of each wrist strap having a second element of a wrist strap fastener adapted to detachably and fixedly engage with any one of the first elements of any wrist strap fastener attached to the upper edge of said first band; said second end of each wrist strap having an adjustable loop for securing said second end of each wrist strap to a wrist of the user; said loop further comprising a thumb loop for encircling the thumb of the user; said loop and thumb loop leaving the palm and the back of the hand essentially uncovered; the overall length of said wrist straps being adjustable between about 8 inches to about 22 inches and the length of the wrist strap being adjusted such that when the hand is placed in the position of maximum tension for 30 seconds, the hand does not twitch; and a single length-adjustable foot strap, said foot strap further comprising a non-removable, fixed-length elastic member, said foot strap having a first end and a second end, said first end of said foot strap having a second element of a foot strap fastener adapted to detachably and fixedly engage with one of the first elements A or B attached to the lower edge of said first band; said second end of said foot strap adapted for securing said second end of said foot strap to a foot of the user; wherein said foot strap is adapted to position said elastic member of said foot strap at the heel of the foot to which said foot strap is secured.

2. A sports training belt as described in claim 1 further comprising a first element of a third wrist strap fastener pair and a first element of a fourth wrist strap fastener pair attached to the upper edge of said first band; said elements of said third and said fourth wrist strap fastener pairs spaced about equidistant from the middle of said first band and spaced proximal to said first element of said first wrist strap fastener and proximal to said first element of said second wrist strap fastener.

3. A sports training belt as described in claim 2 further comprising a second band of stretchable fabric configured to wrap around the waist of a user; said second band having a first end, a second end, an inside surface and an outside surface; said second band having an essentially rectangular shape; said second band fixedly attached to said first band at a point of attachment such that the inner surface of said second band and said outer surface of said first band face each other; said first end of said second band is removably attachable to said first end of said first band and said second end of said second band is removably attachable to said second end of said first band.

4. A sports training belt as described in claim 3 wherein said point of attachment is about the midpoint of said first band and about the midpoint of said second band.

5. A sports training belt as described in claim 1 wherein said second end of said foot strap is adapted to be secured to the instep and secured to the heel of a foot.

6. A sports training belt as described in claim 1 further comprising one or more stiffeners attached to said first band.

7. A sports training belt as described as claim 6 wherein said stiffeners are positioned approximately perpendicular to the long dimension of said first band.

8. A sports training belt as described as in claim 7 wherein one or more of said stiffeners are positioned to be inline with said first element of any wrist strap fastener or positioned to be inline with said first element of any foot strap fastener.

9. A sport training belt as described in claim 1 wherein said elastic member of each of said wrist straps has a non-stretched length of about 5 inches to about 12 inches.

10. A sport training belt as described in claim 9 wherein said elastic member of each of said wrist straps has a non-stretched length of about 7 inches to about 10 inches.

11. A sport training belt as described in claim 1 wherein said elastic member of said foot strap has a non-stretched length of about 7 inches to about 35 inches.

12. A sport training belt as described in claim 11 wherein said elastic member of said foot strap has a non-stretched length of about 10 inches to about 30 inches.

13. A sport training belt as described in claim 1 wherein the overall length of said foot strap is adjustable between about 11 inches to about 38 inches.

14. A sport training belt as described in claim 11 wherein the elastic member of said foot strap has a diameter in the range of about ⅛ inch to about 5⁄16 inch.

15. A sport training belt as described in claim 9 wherein each elastic member of each of said wrist straps has a diameter in the range of about ⅛ inch to about 5⁄16 inch.

16. A sports training belt comprising:

a first band of fabric configured to wrap around the waist of a user; said first band having a first end, a second end, an inside surface, an outside surface, an upper edge and a lower edge; said band having an essentially rectangular shape;

a first paired fastener comprising a first and a second fastener elements; wherein said first fastener element is attached to said first end of said band and wherein said second fastener element is attached to said second of said band so that said first end of said first band and said second end said first band can be detachably secured to each other;

a first element of a first wrist strap fastener pair and a first element of a second wrist strap fastener pair attached to the upper edge of said first band; said elements of said first and said second wrist strap fastener pairs spaced about equidistant from the middle of said first band;

a first element A and a first element B of a foot strap fastener pair attached to the lower edge of said first band; said first elements A and B spaced about equidistant from the middle of said first band;

a pair of wrist straps each comprising an elastic member having a first end and a second end, said first end of each wrist strap having a second element of a wrist strap fastener adapted to detachably and fixedly engage with any one of the first elements of any wrist strap fastener attached to the upper edge of said first band; said second end of each wrist strap having an adjustable loop for securing said second end of each wrist strap to a wrist of the user; said loop further comprising a thumb loop for encircling the thumb of the user; said loop and thumb loop leaving the palm and the back of the hand essentially uncovered;

a single foot strap comprising an elastic member having a first end and a second end, said first end of said foot strap having a second element of a foot strap fastener adapted to detachably and fixedly engage with one of the first elements A or B attached to the lower edge of said first band; said second end of said foot strap adapted for securing said second end of said foot strap to a foot of the user; wherein said foot strap is adapted to position said elastic member of said foot strap at the heel of the foot to which said foot strap is secured;

each of said elastic members of each of said wrists straps has a non-stretched length in the range of about 5 inches to about 12 inches and a diameter in the range of about ⅛ inch to about 5⁄16 inches, each of said wrists straps has an overall length that is adjustable between about 8 inches and about 22 inches; the length of the wrist strap being adjusted such that when the hand is placed in the position of maximum tension each of said wrist straps develops no more than about 7.7 pounds tension; and said elastic member of said foot strap has a non-stretched length in the range of about 7 inches to about 35 inches and a diameter in the range of about ⅛ inch to about 5/16 inches, said foot strap has an overall length that is adjustable between about 11 inches and about 38 inches.

17. A method for developing a skill in a sport comprising the use of the sports training belt of claim 1 for no more than about 20 repetitions per day, wherein said repetition is a movement made by the player while executing a motion actually used while playing the sport.

18. A method for developing a skill in a sport comprising the use of the sports training belt of claim 16 for no more than about 20 repetitions per day, wherein said repetition is a movement made by the player while executing a motion actually used while playing the sport.

* * * * *